US009003985B2

(12) United States Patent
Yamada

(10) Patent No.: US 9,003,985 B2
(45) Date of Patent: Apr. 14, 2015

(54) DEVICE AND NON-TRANSITORY COMPUTER-READABLE MEDIUM

(71) Applicant: Kenji Yamada, Nagoya (JP)

(72) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/052,059

(22) Filed: Oct. 11, 2013

(65) Prior Publication Data

US 2014/0116308 A1 May 1, 2014

(30) Foreign Application Priority Data

Oct. 26, 2012 (JP) ..... 2012-236179

(51) Int. Cl.

| | |
|---|---|
| ***D05B 21/00*** | (2006.01) |
| ***D05B 19/00*** | (2006.01) |
| ***D05B 19/12*** | (2006.01) |
| ***D05C 5/06*** | (2006.01) |
| *D05C 5/02* | (2006.01) |

(52) U.S. Cl.
CPC . *D05B 19/12* (2013.01); *D05C 5/06* (2013.01)

(58) Field of Classification Search
CPC ..... G05B 2219/45195; D05B 19/00; D05B 19/003; D05B 19/02; D05B 19/04; D05B 19/08; D05B 19/10; D05B 21/00; G06T 11/40; G06T 2207/30124; D05C 17/00; D05C 5/02
USPC ..... 112/102.5, 470.04, 103, 220, 475.01, 112/475.17, 475.18, 475.19; 382/111; 700/137, 138; 345/419, 441, 593, 442, 345/443
See application file for complete search history.

(56) References Cited

U.S. PATENT DOCUMENTS

| | | | | |
|---|---|---|---|---|
| 6,098,554 | A * | 8/2000 | Orii et al. | 112/102.5 |
| 6,629,015 | B2 * | 9/2003 | Yamada | 700/138 |
| 7,587,257 | B2 * | 9/2009 | Niimi et al. | 700/138 |
| 7,693,598 | B2 * | 4/2010 | Yamada | 700/138 |
| 8,793,009 | B2 * | 7/2014 | Ihira | 700/138 |
| 2010/0305744 | A1 | 12/2010 | Yamada | |
| 2011/0160894 | A1 * | 6/2011 | Yamada | 700/138 |

FOREIGN PATENT DOCUMENTS

| | | |
|---|---|---|
| JP | A-2001-259268 | 9/2001 |
| JP | A-2010-273859 | 12/2010 |

* cited by examiner

*Primary Examiner* — Ismael Izaguirre
(74) *Attorney, Agent, or Firm* — Oliff PLC

(57) ABSTRACT

A device includes a processor and a memory. The memory is configured to store a plurality of group information pieces, the number of thread colors to be used in embroidery sewing and computer-readable instructions. Each of the group information pieces is associated with one more thread colors among a plurality of thread colors. The computer-readable instructions cause the processor, when executed, to perform processes that includes acquiring image data including pixels, replacing a color of each of the pixels with a thread color from the thread colors, calculating a frequency of using each of the thread colors, selecting, until the number of thread colors selected from the thread colors is equal the number of thread colors to be used stored in the memory, one thread color from each of the group information pieces sequentially, based on the group information pieces stored in the memory and on the calculated frequency.

16 Claims, 12 Drawing Sheets

FIG. 3

| GROUP | A | | | B | | | ··· | | |
|---|---|---|---|---|---|---|---|---|---|
| | R | B | G | R | B | G | ··· | ··· | ··· |
| 1 | r1a | b1a | g1a | r1b | b1b | g1b | ··· | ··· | ··· |
| 2 | r2a | b2a | g2a | ··· | ··· | ··· | ··· | ··· | ··· |
| 3 | ··· | ··· | ··· | ··· | ··· | ··· | ··· | ··· | ··· |
| 4 | ··· | ··· | ··· | ··· | ··· | ··· | ··· | ··· | ··· |
| 5 | ··· | ··· | ··· | ··· | ··· | ··· | ··· | ··· | ··· |
| 6 | ··· | ··· | ··· | ··· | ··· | ··· | ··· | ··· | ··· |
| 7 | ··· | ··· | ··· | ··· | ··· | ··· | ··· | ··· | ··· |
| 8 | ··· | ··· | ··· | – | – | – | – | – | – |

FIG. 7

| GROUP | NUMBER OF COLORS | USE FREQUENCIES | | | | | | | PRIORITY ORDER |
|---|---|---|---|---|---|---|---|---|---|
| | | A | B | C | D | E | F | TOTAL VALUE | |
| 1 | 4 | 0 | 3 | 105 | 5 | – | – | 113 | 3 |
| 2 | 6 | 2 | 2 | 2 | 0 | 3 | 0 | 9 | 8 |
| 3 | 6 | 60 | 100 | 5 | 10 | 35 | 90 | 300 | 1 |
| 4 | 3 | 120 | 80 | 5 | – | – | – | 205 | 2 |
| 5 | 5 | 3 | 4 | 2 | 1 | 5 | – | 15 | 7 |
| 6 | 6 | 16 | 3 | 10 | 0 | 6 | 13 | 48 | 5 |
| 7 | 6 | 7 | 1 | 5 | 5 | 3 | 9 | 30 | 6 |
| 8 | 1 | 80 | – | – | – | – | – | 80 | 4 |

FIG. 10

| GROUP | SUB-GROUP | A | | | B | | | ··· | | |
|---|---|---|---|---|---|---|---|---|---|---|
| | | R | B | G | R | B | G | ··· | ··· | ··· |
| 1 | 1 | r11a | b11a | g11a | r11b | b11b | g11b | ··· | ··· | ··· |
| | 2 | r12a | b12a | g12a | r12b | b12b | g12b | ··· | ··· | ··· |
| 2 | 1 | r21a | b21a | g21a | r21b | b21b | g21b | ··· | ··· | ··· |
| | 2 | ··· | ··· | ··· | ··· | ··· | ··· | ··· | ··· | ··· |
| 3 | 1 | ··· | ··· | ··· | ··· | ··· | ··· | ··· | ··· | ··· |
| | 2 | ··· | ··· | ··· | ··· | ··· | ··· | ··· | ··· | ··· |
| 4 | 1 | ··· | ··· | ··· | ··· | ··· | ··· | ··· | ··· | ··· |

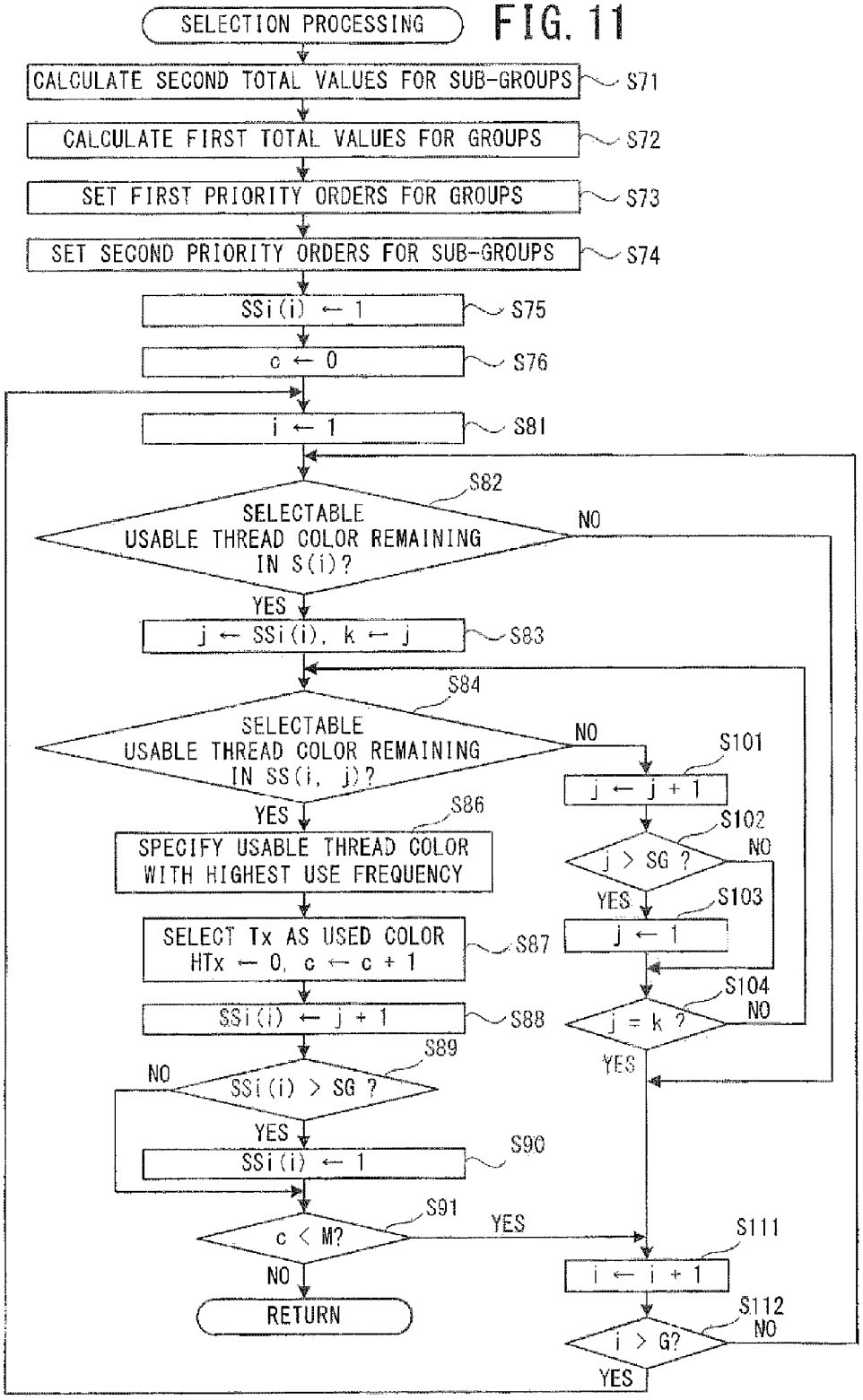
SELECTION PROCESSING
FIG. 11
CALCULATE SECOND TOTAL VALUES FOR SUB-GROUPS
S71
CALCULATE FIRST TOTAL VALUES FOR GROUPS
S72
SET FIRST PRIORITY ORDERS FOR GROUPS
S73
SET SECOND PRIORITY ORDERS FOR SUB-GROUPS
S74
SSi(i) ← 1
S75
c ← 0
S76
i ← 1
S81
S82
SELECTABLE USABLE THREAD COLOR REMAINING IN S(i)?
NO
YES
j ← SSi(i), k ← j
S83
S84
SELECTABLE USABLE THREAD COLOR REMAINING IN SS(i, j)?
NO
S101
j ← j + 1
YES
S86
SPECIFY USABLE THREAD COLOR WITH HIGHEST USE FREQUENCY
S102
j > SG ?
NO
YES
S103
j ← 1
SELECT Tx AS USED COLOR
HTx ← 0, c ← c + 1
S87
S104
j = k ?
NO
SSi(i) ← j + 1
S88
YES
S89
NO
SSi(i) > SG ?
YES
S90
SSi(i) ← 1
S91
c < M?
YES
S111
i ← i + 1
NO
RETURN
S112
i > G?
NO
YES

FIG. 12

| GROUP | SUB-GROUP | NUMBER OF COLORS | USE FREQUENCIES | | | | | | SECOND TOTAL VALUE | SECOND PRIORITY ORDER | FIRST TOTAL VALUE | FIRST PRIORITY ORDER |
|---|---|---|---|---|---|---|---|---|---|---|---|---|
| | | | A | B | C | D | E | F | | | | |
| 1 | 1 | 2 | 0 | – | – | 7 | – | – | 7 | 2 | 117 | 3 |
| | 2 | 2 | – | 5 | 105 | – | – | – | 110 | 1 | | |
| 2 | 1 | 3 | – | 3 | – | – | 4 | 0 | 7 | 1 | 13 | 4 |
| | 2 | 3 | 3 | – | 3 | 0 | – | – | 6 | 2 | | |
| 3 | 1 | 4 | 60 | 100 | – | – | 35 | 90 | 285 | 1 | 300 | 1 |
| | 2 | 2 | – | – | 5 | 10 | – | – | 15 | 2 | | |
| 4 | 1 | 3 | 125 | 80 | 5 | – | – | – | 210 | 1 | 210 | 2 |

DEVICE AND NON-TRANSITORY COMPUTER-READABLE MEDIUM

CROSS-REFERENCE TO RELATED APPLICATION

This application claims priority to Japanese Patent Application No. 2012-236179, filed Oct. 26, 2012, the content of which is hereby incorporated herein by reference in its entirety.

BACKGROUND

The present disclosure relates to a device that is capable of generating embroidery data for performing embroidery sewing by a sewing machine, as well as to a non-transitory computer-readable medium that stores computer-readable instructions that cause a device to generate embroidery data.

A device is known that is capable of generating embroidery data for embroidery sewing, by a sewing machine, of a design that is based on data for an image such as a photograph or the like. The device may generate the embroidery data by the procedure hereinafter described, for example. First, based on the image data, the device calculates angle characteristics for various parts of the image, and strengths of the angle characteristics. The device arranges line segments in accordance with the calculated angle characteristics and the strengths. The device sets thread colors that correspond to the individual line segments and connects the line segments that have the same thread color. The device generates the embroidery data by converting data for the line segments into data that indicate stitches. The device selects the thread colors that correspond to the individual line segments from among a set of n thread colors that have been set in advance as the thread colors that will actually be used when the embroidery sewing is performed.

SUMMARY

In a case where an image such as a photograph or the like is expressed in the form of an embroidery design, the number of the thread colors that are actually used is generally around ten. It is therefore important to select, from among approximately one-hundred thread colors that a user can prepare, the approximately ten thread colors that are best suited to expressing the original image. The device that is described above performs processing that reduces the colors of the original image to N colors, then selects as the used thread colors, from among the thread colors that the user can prepare, a set of n thread colors, each of which is close to one of the N colors. However, in a case where the selected set of n colors includes a plurality of colors that appear to the human eye to be similar, the number of colors that can be expressed by the set of n thread colors as a whole is less than in a case where the set of n thread colors includes only mutually dissimilar colors.

Various embodiments of the broad principles derived herein provide a device that is capable of generating embroidery data by selecting, from among thread colors that can be used, thread colors that are suitable for expressing the original image, and also provide a non-transitory computer-readable medium that stores computer-readable instructions that cause a device to generate the embroidery data.

Various embodiments herein provide a device that includes a processor and a memory. The memory is configured to store a plurality of group information pieces respectively identifying a plurality of groups, the number of thread colors to be used in embroidery sewing, and computer-readable instructions. Each of the plurality of group information pieces is associated with one or more thread colors among a plurality of thread colors. The computer-readable instructions cause the processor, when executed, to perform processes that includes acquiring image data including a plurality of pixels, the image data representing an image, replacing, based on the image data, a color of each one of the plurality of pixels with a thread color from the plurality of thread colors, calculating a frequency of using each of the plurality of thread colors, based on the colors of the plurality of pixels after the replacing of the colors, selecting, until the number of thread colors selected from the plurality of thread colors is equal to the number of thread colors to be used stored in the memory, one thread color from each of the plurality of group information pieces sequentially, based on the plurality of group information pieces stored in the memory and on the calculated frequency of using each of the plurality of thread colors, and generating embroidery data for forming stitches in the selected thread colors by a sewing machine, based on the image data and the selected thread colors.

Various embodiments also provide a non-transitory computer-readable medium storing computer-readable instructions. When executed by a processor of a device, the computer-readable instructions cause the processor to perform processes that includes acquiring image data including a plurality of pixels, the image data representing an image, replacing, based on the image data, a color of each one of the plurality of pixels with a thread color from a plurality of thread colors, calculating a frequency of using each of the plurality of thread colors, based on the colors of the plurality of pixels after the replacing of the colors, selecting, until the number of thread colors selected from the plurality of thread colors is equal to the number of thread colors to be used stored in a memory, one thread color from each of a plurality of group information pieces sequentially, based on the plurality of group information pieces and on the calculated frequency of using each of the plurality of thread colors, and generating embroidery data for forming stitches in the selected thread colors by a sewing machine, based on the image data and the selected thread colors. The plurality of group information pieces are stored in the memory and respectively identify a plurality of groups. Each of the plurality of group information pieces is associated with one or more thread colors among the plurality of thread colors.

BRIEF DESCRIPTION OF THE DRAWINGS

Embodiments will be described below in detail with reference to the accompanying drawings in which:

FIG. 3 is an explanatory figure of an example of a thread color table;

FIG. 7 is an explanatory figure of an example of a use frequency table;

FIG. 10 is an explanatory figure of an example of a thread color table that is used in a third embodiment;

FIG. 11 is a flowchart of selection processing according to the third embodiment; and FIG. 12 is an explanatory figure of an example of a use frequency table that is used in the third embodiment.

DETAILED DESCRIPTION

First Embodiment

Hereinafter, a first embodiment will be explained with reference to FIGS. 1 to 7. First, a configuration of an embroidery data generation device 1 will be explained with reference to FIG. 1. The embroidery data generation device 1 is a device that is capable of generating embroidery data for use by a sewing machine 3 (refer to FIG. 2) that will be described later, for forming stitches of an embroidery pattern. The embroidery data generation device 1 of the present embodiment is capable of generating embroidery data for performing embroidery sewing of a design that is based on an image such as a photograph or the like.

Figure 1:
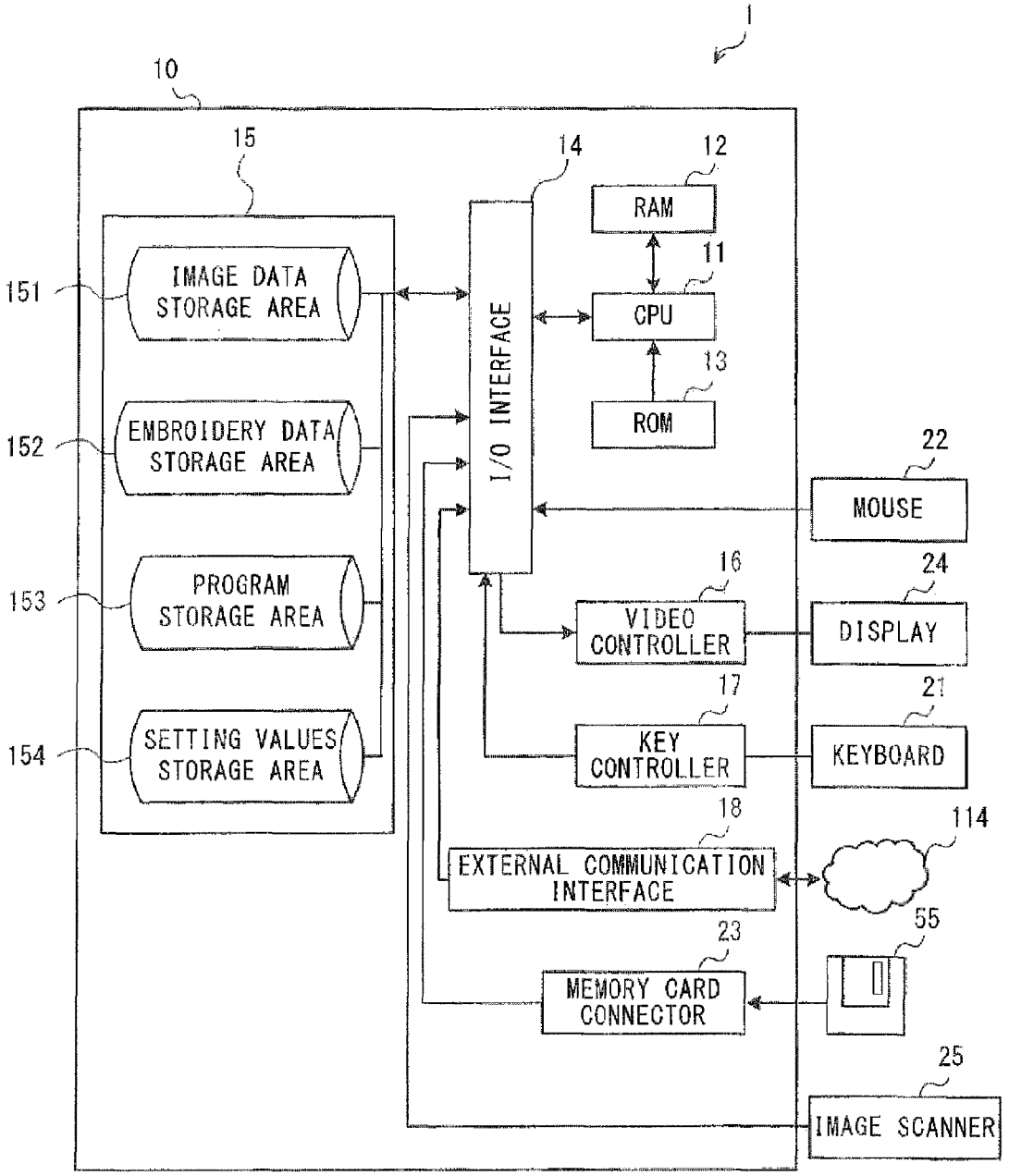
FIG. 1 is a block diagram that shows an electrical configuration of an embroidery data generation device.

The embroidery data generation device 1 may be a dedicated device that only generates the embroidery data. The embroidery data generation device 1 may also be a general-purpose device such as a personal computer or the like. In the present embodiment, a general-purpose form of the embroidery data generation device 1 is explained as an example. As shown in FIG. 1, the embroidery data generation device 1 includes a CPU 11, which is a controller that performs control of the embroidery data generation device 1. A RAM 12, a ROM 13, and an input/output (I/O) interface 14 are connected to the CPU 11. The RAM 12 may temporarily store various types of data, such as calculation results that are produced in calculation processing by the CPU 11, and the like. The ROM 13 may store a BIOS and the like.

The I/O interface 14 performs mediation of data transfers. A hard disk device (HDD) 15, a mouse 22, which is an input device, a video controller 16, a key controller 17, an external communication interface 18, a memory card connector 23, and an image scanner 25 are connected to the I/O interface 14.

A display 24, which is a display device, is connected to the video controller 16. A keyboard 21, which is an input device, is connected to the key controller 17. The external communication interface 18 is an interface that enables connection to a network 114. The embroidery data generation device 1 can connect to an external device through the network 114. A memory card 55 can be connected to the memory card connector 23. Through the memory card connector 23, the embroidery data generation device 1 is able to read data from the memory card 55 and write data to the memory card 55.

Storage areas in the HDD 15 will be explained. As shown in FIG. 1, the HDD 15 has a plurality of storage areas that include an image data storage area 151, an embroidery data storage area 152, a program storage area 153, and a setting values storage area 154. Image data for various types of images, such as images that become the basis for the embroidery data generation, and the like, may be stored in the image data storage area 151. Embroidery data that are generated by embroidery data generation processing in the present embodiment may be stored in the embroidery data storage area 152. Programs for various types of processing that are performed by the embroidery data generation device 1, such as an embroidery data generation program that will be described later and the like, may be stored in the program storage area 153.

The embroidery data generation program may be stored in the program storage area 153 after being acquired from outside through the network 114. In a case where the embroidery data generation device 1 is provided with a DVD drive, the embroidery data generation program may be stored in a medium such as a DVD or the like and may be read and then stored in the program storage area 153.

Data on setting values that are to be used by various types of processing may be stored in the setting values storage area 154. As an example of the setting values data in the present embodiment, data are stored that relate to one or more groups of one or more thread colors that have been classified in advance by a person. Each group includes one or more of a plurality of thread colors that are usable in embroidery sewing. Hereinafter, a thread color that is usable in embroidery sewing will be called a usable thread color. In the present embodiment, a thread color table is stored in the setting values storage area 154 as the data relating to the one or more groups of the one or more thread colors. The thread color table is a table that is generated by classifying the plurality of usable thread colors in advance, based on the criteria of whether or not a color appears similar to the human eye to another color.

The thread color table that is shown as an example in FIG. 3 is a table in which identification data for the groups (indicated by numbers in FIG. 3), identification data for the one or more usable thread colors within each group (indicated by English letters in FIG. 3), and data that indicate the RGB values for the one or more usable thread colors are associated with one another. More specifically, the thread color table in FIG. 3 is a table for a case in which the plurality of usable thread colors have been classified into eight groups that are identified by the numbers 1 to 8. Note that in FIG. 3, the RGB values are shown only for the usable thread colors that are classified into the group with the number 1 and are identified as A and B within the group, respectively, and for the usable thread color that is classified into the group with the number 2 and is identified as A within the group, the RGB values for the other usable thread colors being omitted from FIG. 3. Hereinafter, the group with the number 1 will also be referred to as group 1, the usable thread color with the English letter A will also be referred to as the thread color A, and so on.

The generation of the thread color table, that is, the dividing of the usable thread colors into groups, may be performed in response to inputs by a user of the embroidery data generation device 1, for example, at least before the embroidery data generation processing is started. In this case, the user may divide the usable thread colors into groups while looking at the usable thread colors from the beginning. Alternatively, based on data that indicate the RGB values for the usable thread colors, the CPU 11 may first group together the usable thread colors among which the distance in the RGB space is not greater than a specified threshold value. The CPU 11 may then perform processing that takes a color within the group that is specified by the user specifies to be dissimilar to the other colors and puts the color into a different group. The thread color table does not necessarily have to be generated by the user. The thread color table may also be generated in advance by an operator at an embroidery thread manufacturer, and provided to the user afterward, for example.

The thread color table in FIG. 3 is an example in which the number of groups is eight, but the number of groups is not limited to being eight. As explained previously, in a case where the person who classifies the usable thread colors thinks that none of the usable thread colors are mutually similar, the number of groups becomes equal to the number of the usable thread colors. On the other hand, in a case where the person who does the classifying thinks that all of the usable thread colors are mutually similar, the number of groups may become one. In other words, in a case where the number of the usable thread colors is N, a number of groups G is an integer in the range from 1 to N. The data relating to the one or more groups of the one or more thread colors may be any data as long as the data at least make it possible to specify the group to which each one of the plurality of usable thread colors belongs. Therefore, the data are not limited to being in the table format that is shown as an example in FIG. 3.

Figure 2:
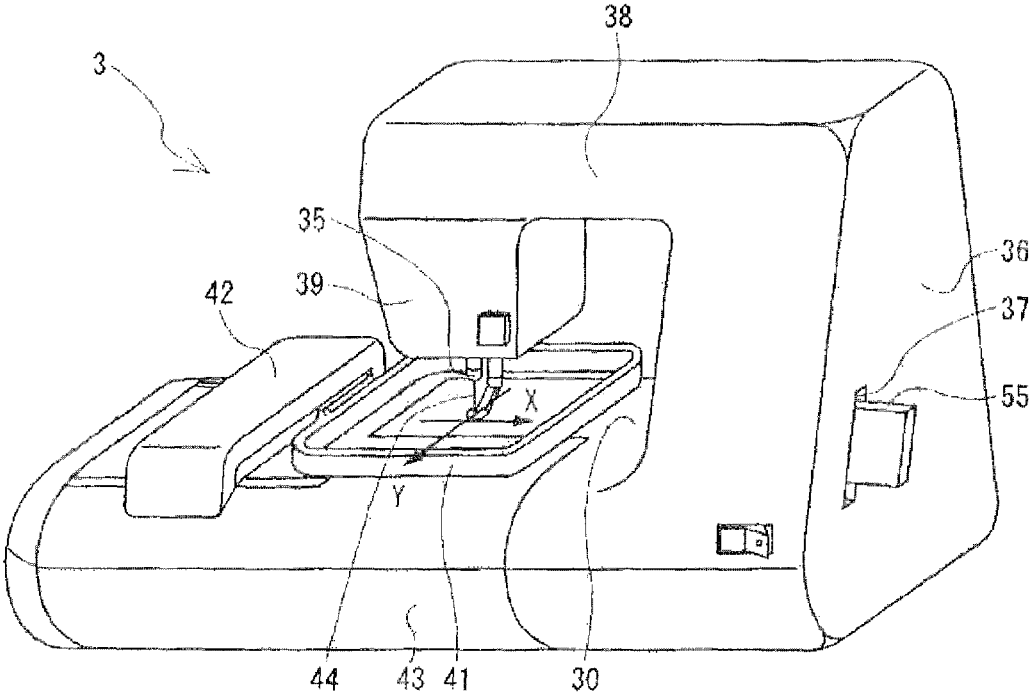
FIG. 2 is an exterior view of a sewing machine.

The sewing machine 3, which is capable of sewing an embroidery pattern that is based on the embroidery data, will be briefly explained with reference to FIG. 2. As shown in FIG. 2, the sewing machine 3 has a bed 30, a pillar 36, and arm 38, and a head 39. The bed 30 is the base of the sewing machine 3 and is long in the left-right direction. The pillar 36 extends upward from the right end portion of the bed 30. The arm 38 extends to the left from the upper end of the pillar 36 such that the arm 38 is positioned opposite the bed 30. The head 39 is a portion that is joined to the left end of the arm 38.

When embroidery sewing is performed, a user of the sewing machine 3 mounts an embroidery frame 41 that holds a work cloth onto a carriage 42 that is disposed on the bed 30. The embroidery frame 41 may be moved by a Y direction moving mechanism (not shown in the drawings) that is contained in the carriage 42 and by an X direction moving mechanism (not shown in the drawings) that is contained in a main case 43 to a needle drop point that is indicated by an XY coordinate system that is unique to the sewing machine 3. In conjunction with the moving of the embroidery frame 41, a shuttle mechanism (not shown in the drawings) and a needle bar 35 to which a sewing needle 44 is attached may be operated, thereby forming an embroidery pattern on the work cloth. Note that the Y direction moving mechanism, the X direction moving mechanism, the needle bar 35, and the like may be controlled based on the embroidery data by a CPU (not shown in the drawings) that is built into the sewing machine 3. In the present embodiment, the embroidery data are data that indicate the coordinates of the needle drop points, the sewing order, and the colors of the embroidery threads to be used in order to form the stitches of the embroidery pattern.

A memory card slot 37 in which the memory card 55 can be removably inserted is provided on the right side face of the pillar 36 of the sewing machine 3. The embroidery data that have been generated by the embroidery data generation device 1, for example, may be stored in the memory card 55 through the memory card connector 23. Then the memory card 55 may be inserted in the memory card slot 37 of the sewing machine 3, and the embroidery data that are stored in the memory card 55 may be read out and stored in the sewing machine 3. Based on the embroidery data that have been read from the memory card 55, the CPU of the sewing machine 3 may control the operation of the sewing of the embroidery pattern by the Y direction moving mechanism, the X direction moving mechanism, the needle bar 35, and the like. Thus the sewing machine 3 is able to sew the embroidery pattern based on the embroidery data that have been generated by the embroidery data generation device 1.

The embroidery data generation processing that is performed by the embroidery data generation device 1 according to the first embodiment will be explained with reference to FIGS. 4 to 7. The embroidery data generation processing is started when the user inputs a command to start the processing. The CPU 11 reads the embroidery data generation program that is stored in the program storage area 153 of the HDD 15 and performs the processing described below by executing instructions that are included in the program.

Figure 4:
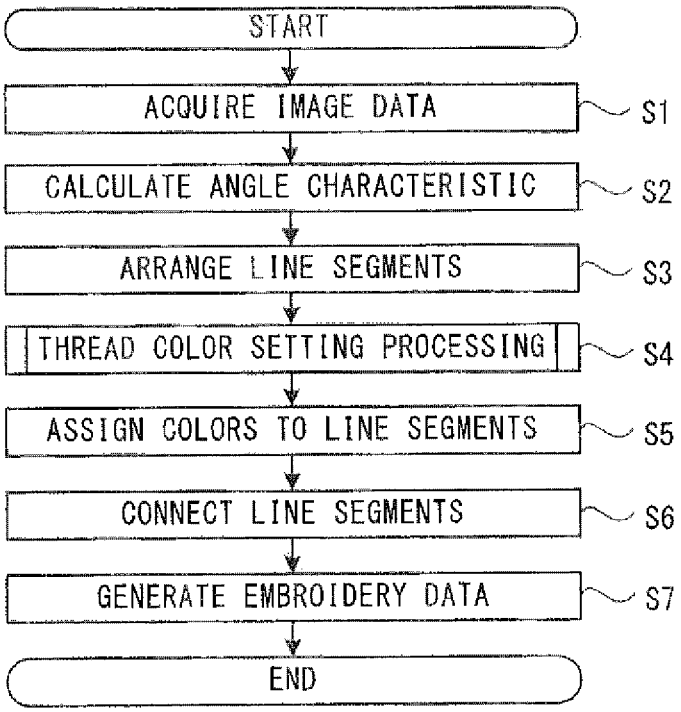
FIG. 4 is a flowchart of embroidery data generation processing.

As shown in FIG. 4, first, the CPU 11 acquires image data representing an image that serves as the basis for generating the embroidery data (hereinafter called an original image) (Step S1). There are no particular restrictions on the method for acquiring the image data. For example, image data that have been acquired by the image scanner 25 by scanning a photograph, a design, or the like, for example, may be used. In addition, the CPU 11 may also acquire image data that are stored in the image data storage area 151 of the HDD 15. The CPU 11 may also acquire image data from outside through the network 114. The CPU 11 may also acquire image data that are stored in a medium such as the memory card 55 or the like. In the present embodiment, at Step S1, the CPU 11 acquires image data in which a color of each of a plurality of pixels that make up the original image is represented by RGB values. The image data may also be data that represent the color of each pixel in another format, instead of by the RGB values.

Based on the acquired image data, the CPU 11 calculates an angle characteristic and a strength of the angle characteristic for each of the plurality of pixels that make up the original image (Step S2). The angle characteristic is information that indicates a direction in which continuity of the color within the image is high. The strength of the angle characteristic is information that indicates a magnitude of a change in the color. The CPU 11 may use any sort of method to calculate the angle characteristic and the strength of the angle characteristic. For example, the CPU 11 can calculate the angle characteristic and the strength of the angle characteristic using the method that is described in detail in Japanese Laid-Open Patent Publication No. 2001-259268, the relevant portion of which is incorporated herein by reference. Other than that method, the CPU 11 may also calculate the angle characteristic and the strength of the angle characteristic using a Prewitt operator or a Sobel operator.

Based on the angle characteristics and the strengths of the angle characteristics that have been calculated, the CPU 11 performs processing that arranges line segments, then stores data that specify the line segments (hereinafter called the line segment data) in the RAM 12 (Step S3). The CPU 11 may use any sort of method to arrange the line segments based on the angle characteristics and the strengths of the angle characteristics. For example, the CPU 11 can use the method that is described in detail in Japanese Laid-Open Patent Publication No. 2001-259268, the relevant portion of which is incorporated herein by reference.

Next, the CPU 11 performs thread color setting processing (Step S4). The thread color setting processing is processing that, from among the plurality of N usable thread colors, sets colors of a plurality of threads that will actually be used in embroidery sewing. Hereinafter, the colors of the threads that will actually be used in embroidery sewing will be called used thread colors.

The thread color setting processing will be explained in detail with reference to FIGS. 5 to 7. First, the CPU 11 sets a number of used thread colors M, which is the number of the used thread colors (Step S11). The number of used thread colors M is an integer that is less than N, the total number of the usable thread colors. As the number of used thread colors M, the CPU 11 may, for example, set a value that is determined in advance by taking into consideration a number of thread replacements or the like, and that is stored in the setting values storage area 154 of the HDD 15. The CPU 11 may also set the number of used thread colors M to a value that is input by the user. The CPU 11 stores in the RAM 12 the number of used thread colors M that has been set. In consideration of the number of thread replacements and the like, in general, the number of used thread colors M may be set to a value of approximately ten.

The CPU 11 performs color reduction processing (Step S12). The color reduction processing in the present embodiment is processing that replaces a color of each one of the plurality of pixels that make up the original image with one of the N usable thread colors that are contained in the thread color table (refer to FIG. 3). For example, the CPU 11 may perform approximate color conversion. Specifically, the CPU 11 refers to the image data for the original image and the thread color table and calculates distances in the RGB space between the RGB values for each pixel and the RGB values for each of the N usable thread colors. The CPU 11 may replace the RGB values for each pixel with the RGB values for the usable thread color for which the distance is the shortest among the N usable thread colors. However, the color reduction method that is used at Step S12 is not limited to approximate color conversion, and another known method, such as dithering or the like, for example, may also be used.

Approximate color conversion may be more appropriate in a case where the colors of the original image will be reproduced in a single color. Dithering may be more appropriate in a case where the original image will be reproduced using mixed color expression that simulates intermediate colors by using a plurality of colors. However, mixed color expression by embroidery threads is not able to express intermediate colors as accurately as can be done by dithering in ordinary image processing. Accordingly, at Step S12, the CPU 11 may use approximate color conversion in a case where the resolution of the original image is higher than a specified threshold value and may use dithering in a case where the resolution is not higher than a specified threshold value, for example.

The CPU 11 then calculates a frequency of using each of the usable thread colors, based on the colors of the pixels after the color reduction processing (Step S13). Specifically, for each of the usable thread colors, the CPU 11 counts the number of pixels that have the same RGB values as the usable thread color. The CPU 11 sets the number of pixels that are counted for the usable thread color as the frequency of using that usable thread color. The frequency of using a usable thread color will be hereinafter called a use frequency for the usable thread color.

The CPU 11 sets a first threshold value T1 (Step S14) and sets a second threshold value T2 (Step S15). In selection processing that will be described later, the first threshold value T1 is used for excluding a group from the selection of the used thread colors in a case where the total value of the use frequencies for all of the one or more usable thread colors that belong to the group (hereinafter also simply called the total value of the group use frequencies) is not greater than the first threshold value T1. In the selection processing that will be described later, the second threshold value T2 is used for excluding a usable thread color from the selection of the used thread colors in a case where the use frequency for the usable thread color is not greater than the second threshold value T2. The CPU 11 may set the first threshold value T1 and the second threshold value T2 to values that are respectively determined in advance and stored in the setting values storage area 154 of the HDD 15. The CPU 11 may also set the first threshold value T1 and the second threshold value T2 to values that are respectively input by the user. The CPU 11 stores in the RAM 12 the first threshold value T1 and the second threshold value T2 that have been set.

Next, the CPU 11 performs the selection processing (Step S20). The selection processing is processing that sets priority orders for the groups in descending order of the total values of the use frequencies for the individual groups, then selects, as the used thread colors, the usable thread color with the highest use frequency within each group, processing the groups in sequence, according to the priority orders, until the number of the used thread colors reaches the number of used thread colors M.

The selection processing will be explained in detail with reference to FIGS. 6 and 7. The CPU 11 sets a variable c to zero and stores the variable c in the RAM 12 (Step S21). The variable c is a variable for counting a number of selections, which is the number of the used thread colors that have been selected. The CPU 11 also sets a variable c1 to the variable c, a variable b1 to 1, and a variable b2 to 1, then stores the variables in the RAM 12 (Step S22). The variable c1 is a variable to be used for determining whether or not a used thread color has been selected in the current processing cycle. The variables b1 and b2 are flags that respectively indicate whether or not the first threshold value T1 and the second threshold value T2 are to be used. The variable b1 that is set to 1 indicates that the first threshold value T1 is to be used. The variable b1 that is set to zero indicates that the first threshold value T1 is not to be used. The variable b2 that is set to 1 indicates that the second threshold value T2 is to be used. The variable b2 that is set to zero indicates that the second threshold value T2 is not to be used.

Based on the use frequencies for the usable thread colors that were calculated at Step S13, the CPU 11 calculates the total value of the use frequencies for each group and stores the total values in the RAM 12 (Step S24). Specifically, the CPU 11 refers to the thread color table (refer to FIG. 3) that is stored in the setting values storage area 154 and for each one of the groups, calculates the total value of the use frequencies for all of the one or more usable thread colors that belong to the group. The CPU 11 also sets the priority orders for the groups in descending order of the total values of the use frequencies for the individual groups that were calculated at Step S24 (Step S25). In a case where some of groups have the same total value of the group use frequencies, CPU 11 may give priority to any one of those groups. In the present embodiment, in this sort of case, the CPU 11 sets the priority orders in the order in which the groups are registered in the thread color table. In the example in FIG. 3, this becomes ascending order by the group number.

In the present embodiment, based on the thread color table that is stored in the setting values storage area 154, on the use frequencies that were calculated at Step S13, on the total values of use frequencies that were calculated at Step S24, and on the priority orders that were set at Step S25, the CPU 11 generates a use frequency table such as shown in FIG. 7 and stores the table in the RAM 12.

The use frequency table that is shown in FIG. 7 is an example that is generated for an original image of 800 pixels by referring to a thread color table, in which thirty-seven usable thread colors were classified in advance into eight groups. In the use frequency table in FIG. 7, identification data for the groups (numbers), the number of the one or more usable thread colors that belong to each one of the groups, the use frequency for each of the one or more usable thread colors that belong to each one of the groups, the total value of the use frequencies for each one of the groups, and the priority order for each one of the groups are associated with one another. However, because it is sufficient for the CPU 11 to be able, when necessary, to specify each of the usable thread colors and the use frequencies of the usable thread colors, as well as the priority order for each one of the groups, this sort of use frequency table does not necessarily have to be generated.

The CPU 11 sets a variable i to 1 and stores the variable i in the RAM 12 (Step S31). The variable i is a variable that specifies the group that is an object of the processing in accordance with the priority order that was set at Step S25. In other words, at Step S31, the group for which 1 was set as the priority order (group 3 in the example in FIG. 7) is specified as the object of the processing. The CPU 11 determines whether or not at least one of the two conditions described below is satisfied (Step S32). The first condition is that the variable b1 that is stored in the RAM 12 is zero, that is, that the variable b1 has been set such that the first threshold value T1 is not to be used. The second condition is that the total value of the use frequencies for the group with the priority order of i, which is the object of the processing, is greater than the first threshold value T1. The CPU 11 may specify the total value of the use frequencies for the group that is the object of the processing by referring to the use frequency table in the RAM 12. Hereinafter, the group with the priority order of i will also be referred to as the group S(i), and the total value of the use frequencies for the group S(i) will also be referred to as GH(S(i)).

In a case where none of the two conditions is satisfied (NO at Step S32), the CPU 11 advances the processing to Step S41, which will be described later. In other words, in a case where the variable b1 has been set such that the first threshold value T1 is to be used and GH(S(i)) is not greater than the first threshold value T1, the group that is the object of the processing (hereinafter called an object group) is excluded from the selection of the used thread colors. On the other hand, in a ease where at least one of the two conditions is satisfied (YES at Step S32), the CPU 11 advances the processing to Step S33 in order to select a used thread color from the object group S(i).

The CPU 11 determines whether or not a usable thread color that can be selected, that is, a usable thread color that has not yet been selected as a used thread color, is remaining in the object group (Step S33). In a case where the processing has been repeated several times and all of the usable thread colors in the object group have been selected as used thread colors (NO at Step S33), the CPU 11 advances the processing to Step S41.

In a case where there is a usable thread color in the object group that has not yet been selected (YES at Step S33), the CPU 11 refers to the use frequency table in the RAM 12 and specifies the usable thread color with the highest use frequency among the unselected usable thread colors (Step S34). For example, in a case where the use frequency table in FIG. 7 is referenced, a usable thread color B that has the highest use frequency of 100 is specified, among the unselected usable thread colors that belong to the object group S(i), that is, group 3.

In a case where a plurality of usable thread colors have the highest use frequency, the CPU 11 may specify any one of those usable thread colors. In the present embodiment, in that case, the CPU 11 specifies the first usable thread color in the order in which the colors are registered in the thread color table (alphabetical order in the example in FIG. 3). Hereinafter, the usable thread color that is specified at Step S34 will also be referred to as the usable thread color Tx, and the use frequency for the usable thread color Tx will also be referred to as the use frequency HTx.

The CPU 11 determines whether or not at least one of the two conditions described below is satisfied (Step S35). The first condition is that the variable b2 that is stored in the RAM 12 is zero, that is, that the variable b2 has been set such that the first threshold value T2 is not to be used. The second condition is that the use frequency HTx for the usable thread color Tx is greater than the second threshold value T2.

In a case where none of the two conditions is satisfied (NO at Step S35), the CPU 11 advances the processing to Step S41. In other words, in a case where the variable b2 has been set such that the second threshold value T2 is to be used and the use frequency HTx is not greater than the second threshold value T2, the usable thread color Tx is excluded from the selection of the used thread colors. On the other hand, in a case where at least one of the two conditions is satisfied (YES at Step S35), the CPU 11 selects, as a used thread color, the usable thread color Tx that was specified at Step S34, stores information that identifies the usable thread color Tx in the RAM 12, sets the value of the use frequency HTx to zero in the use frequency table, and adds 1 to the value of the variable c (Step S36). The CPU 11 determines whether or not the variable c is less than the number of used thread colors M (Step S37). In a case where the variable c is less than the number of used thread colors M (YES at Step S37), the number of selections has not reached the number of used thread colors M. In that case, the CPU 11 advances the processing to Step S41. At Step S41, the CPU 11 adds 1 to the value of the variable i to set the next group in the priority order as the object of the processing.

Next, the CPU 11 determines whether or not the variable i has exceeded the number of groups G, that is, whether or not all of the groups have been the object of a full round of the processing (Step S42). If the variable i has not exceeded the number of groups G (NO at Step S42), there are still one or more groups that have not been made the object of the processing, so the CPU 11 returns to the processing at Step S32. For as long as the number of selections has not reached the number of used thread colors M, the CPU 11 repeats the processing at Steps S32 to S42, making each of the remaining groups the object of the processing one at a time.

In a case where the number of groups G is not less than the number of used thread colors M, the total value of the use frequencies for each of the groups is greater than the first threshold value T1, and each of the groups includes a usable thread color for which the use frequency is greater than the second threshold value T2, the selection of M used thread colors can be completed in the first round of processing for all of the groups. In that case, the variable c, that is, the number of selections, reaches the number of used thread colors M (NO at Step S37). Accordingly, the CPU 11 terminates the selection processing and returns to the thread color setting processing in FIG. 5.

On the other hand, in a case where the number of used thread colors M is greater than the number of groups G, the variable i exceeds the number of groups G (YES at Step S42) in a state in which the number of selections has not reached the number of used thread colors M. In the same manner, the variable i may also exceed the number of groups G (YES at Step S42) in a case where, for one or more of the groups, the total values of the use frequencies or the use frequencies of the usable thread colors do not satisfy their respective specified conditions, even though the number of groups G is not less than the number of used thread colors M. In those cases, the selection of M used thread colors is not completed in the first round of processing.

The CPU 11 determines whether or not the variable c and the variable c1 are equal (Step S43). The variable c1 was set to the same value as the variable c at Step S22, and has not been changed. On the other hand, if the processing at Steps S32 to S42 has been performed for each of the G groups and one or more used thread colors have been selected, the variable c has been changed to a value that corresponds to the number of the used thread colors that have been selected. Accordingly, in a case where a used thread color has been selected, the variable c and the variable c1 are different from one another (NO at Step S43). In that case, the CPU 11 returns the processing to Step S22 and starts a second round of processing.

Note that at Step S22, the CPU 11 once again sets the variable c1 to the variable c, so the variable c1 becomes the number of selections, that is, the number of the used thread colors that have already been selected. Furthermore, in the preceding round of the processing at Step S36, the use frequency HTx for the usable thread color Tx that was selected as a used thread color was reset to zero. Accordingly, in the second and subsequent rounds of the processing at Step S24, the calculating of the total values of the use frequencies by the CPU 11 is equivalent to the calculating of the total values of the use frequencies for the groups, excluding the use frequencies for the usable thread colors in each group that have already been selected as used thread colors. In the second and subsequent rounds of the processing at Steps S24 and S25, the total values of the use frequencies and the priority orders that were previously stored in the RAM 12 are replaced by the newly calculated total values of the use frequencies and priority orders.

In a case where not even one used thread color has been selected, even after the processing at Steps S32 to S42 has been performed for all of the individual groups, the variable c remains to be equal to the variable c1 (YES at Step S43). In that case, the CPU 11 cannot select M used thread colors for as long as the first threshold value T1 and the second threshold value T2 continue to be used. Accordingly, in a case where the variable b1 is 1, that is, the variable b1 is set such that the first threshold value T1 is to be used (YES at Step S44), the CPU 11, by setting the variable b1 to zero, sets the variable b1 such that the first threshold value T1 is not to be used (Step S45). The CPU 11 returns to the processing at Step S31 and performs the full round of the processing that was described above, in order, starting with the group S(1) with the highest priority order. In this case, the variable b1 is zero (YES at Step S32), so even if the total value GH(S(i)) of the use frequencies for the object group S(i) is not greater than the first threshold value T1, the group S(i) is not excluded from the selection of the used thread colors.

Even if the variable b1 is set at Step S45 such that the first threshold value T1 is not to be used, in a case where the use frequencies of the unselected usable thread colors in all of the groups are not greater than the second threshold value T2 (NO at Step S35), not even one used thread color is selected. Accordingly, even if the processing at Steps S32 to S42 is performed for all of the individual groups, the variable c remains to be equal to the variable c1 (YES at Step S43). In that case, the variable b1 is zero (NO at Step S44). Accordingly, the CPU 11, by setting the variable b2 to zero, sets the variable b2 such that the second threshold value T2 is not to be used (Step S46).

The CPU 11 returns to the processing at Step S31 and performs the full round of the processing that was described above, in order, starting with the group S(1) with the highest priority order. In this case, the variable b2 is zero (YES at Step S35), so even if the highest use frequency HTx among the use frequencies for the unselected usable thread colors in the object group S(i) is not greater than the second threshold value T2, the usable thread color Tx is not excluded from the selection of the used thread colors.

In this manner, the CPU 11 repeats the processing that selects, as a used thread color, one of the usable thread colors from each of the groups, in accordance with the priority orders of the groups. When the number of selections reaches the number of used thread colors M (NO at Step S37), the CPU 11 terminates the selection processing and returns to the thread color setting processing in FIG. 5.

Figure 5:
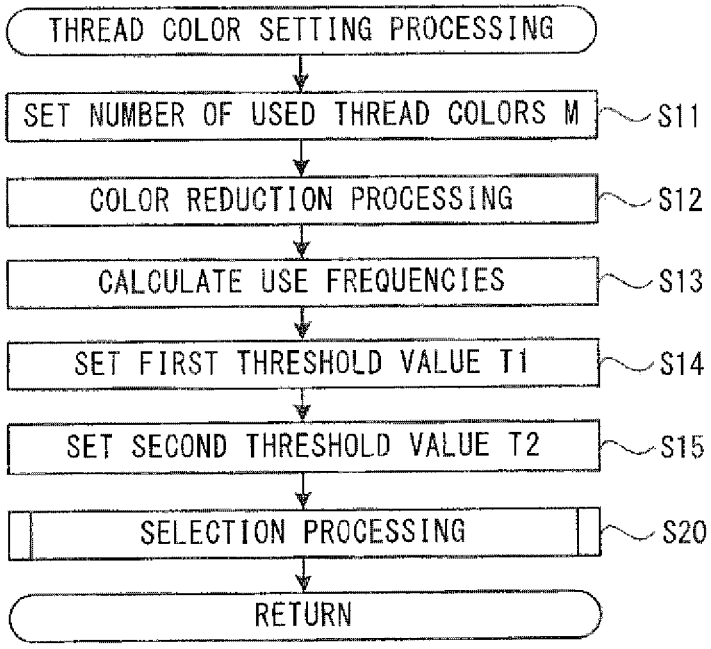
FIG. 5 is a flowchart of thread color setting processing according to a first embodiment.
Figure 6:
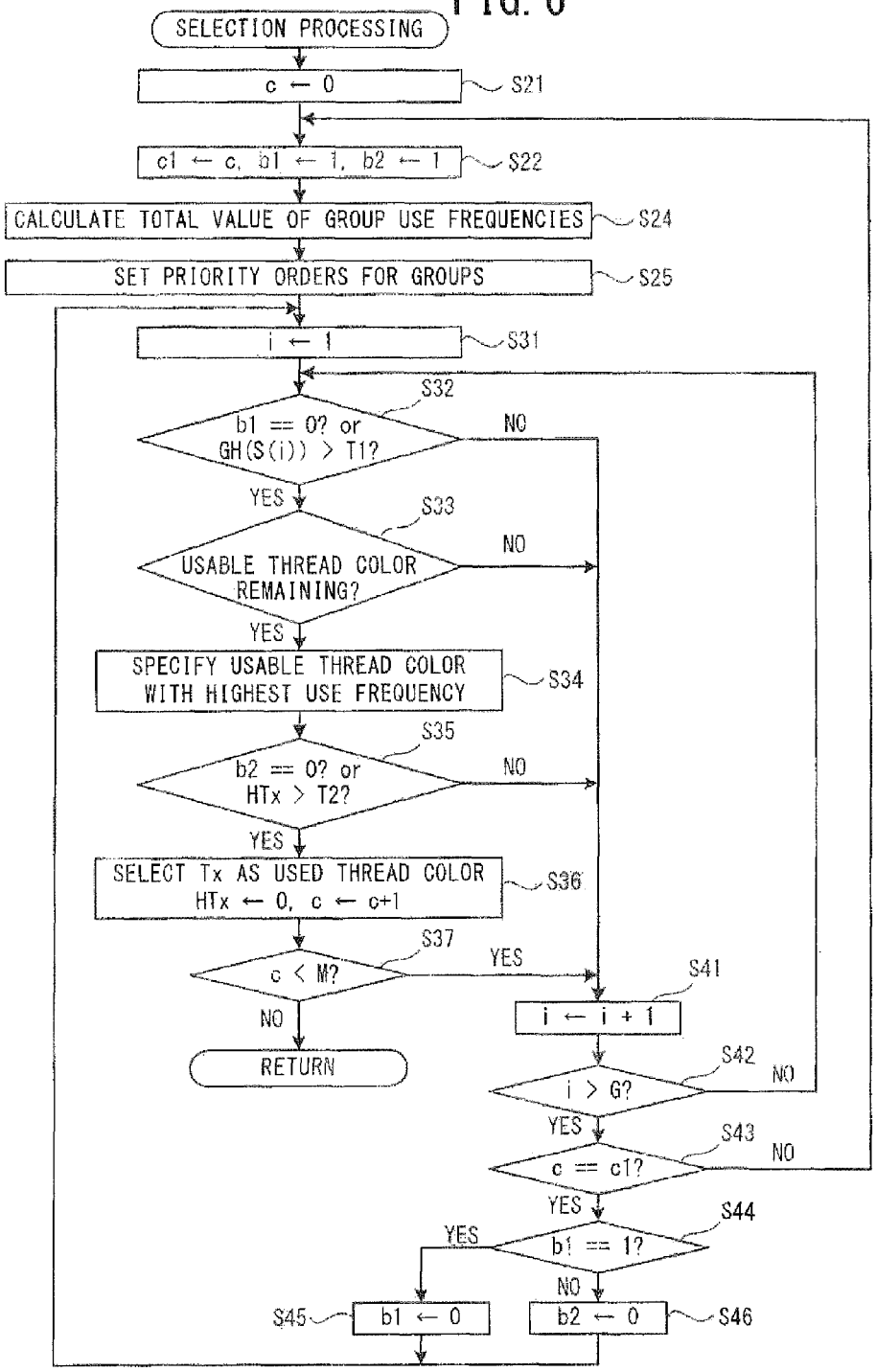
FIG. 6 is a flowchart of selection processing according to the first embodiment.

As shown in FIG. 5, after the selection processing (Step S20), the CPU 11 terminates the thread color setting processing and returns to the embroidery data generation processing in FIG. 4. As shown in FIG. 4, following the thread color setting processing (Step S4), the CPU 11 performs processing that, based on the image data for the original image, generates the embroidery data for the forming by the sewing machine 3 of the stitches of the M used thread colors that were set by the thread color setting processing (Steps S5 to S7). The CPU 11 may use any sort of method to perform the processing at Steps S5 to S7. For example, the CPU 11 may use the method that is described in detail in Japanese Laid-Open Patent Publication No. 2001-259268, the relevant portion of which is incorporated herein by reference. The content of the processing will now be briefly explained.

The CPU 11 performs color assignment processing that sets the colors of the line segments that were arranged at Step S3 (Step S5). Based on the image data for the original image, for each of the line segments, the CPU 11 selects, from among the M used thread colors that were set by the thread color setting processing, one color that reflects the color in the original image and sets that color as the color of the line segment. The colors of the line segments will be the colors of the actual stitches. The CPU 11 performs processing that generates line segment data for each of the used thread colors by sequentially connecting the line segments that have the same used thread color, among the plurality of line segments to which the colors have been assigned (Step S6). The CPU 11 defines the two end points of one line segment as a starting point and an ending point, respectively, of a stitch. The CPU 11 then locates the end point of another line segment of the same color that is in the position that is closest to the ending point of the first line segment, and defines that end point as the starting point of the next stitch. The CPU 11 connects the line segments by repeating this process.

The CPU 11 generates the embroidery data based on the line segment data that was generated for each of the used thread colors at Step S6 (Step S7). The CPU 11 calculates the coordinates of the needle drop points by converting the coordinates of the end points of each line segments into the coordinates of the XY coordinate system that is unique the sewing machine 3. The CPU 11 also defines the order in which the line segments are connected as the sewing order for the needle drop points. In this manner, the CPU 11 generates the embroidery data that indicate the coordinates of the needle drop points, the sewing order, and the used thread colors. The CPU 11 then terminates the embroidery data generation processing that is shown in FIG. 4.

As explained above, in the present embodiment, the plurality of usable thread colors are classified in advance by a person into one or more groups, and the thread color table, which contains the information of the one or more groups, are stored in the setting values storage area 154 of the HDD 15. A person can store the thread color table, in which usable thread colors that appear similar to the human eye are classified as belonging to the same group, in the HDD 15, as in the present embodiment. In other words, two colors that would be classified by calculation as not similar, but that appear to the human eye to be sufficiently similar, can be classified into the same group.

The CPU 11 calculates the use frequency for each of the plurality of usable thread colors based on the colors of the pixels in the original image, each color having been replaced by one of the plurality of usable thread colors. The CPU 11 sequentially selects, as a used thread color, one of the usable thread colors from each of the groups until the number of the selected used thread colors (the number of selections) reaches the number of the thread colors (the number of used thread colors M) that will actually be used in the embroidery sewing. More specifically, the CPU 11 sets the priority orders for the groups based on the total values of the use frequencies, and then selects, as the used thread color, the usable thread color with the highest use frequency in each group, processing the groups in descending order of the priority orders.

In a case where an image such as a photograph or the like is expressed in the form of an embroidery design, the image cannot be expressed in as much detail as can be done with pixels, because of limitations on the embroidery threads and the thicknesses of the needles. It is also a reality that the number of the thread colors (the number of used thread colors M) that are actually used in the embroidery sewing is significantly fewer than the number of colors in the pixels. It is therefore important to select, from among the N usable thread colors, the M used thread colors that are most suitable for expressing the original image For example, if, from among the N usable thread colors for which the use frequencies were calculated at Step S13, the CPU 11 simply selects the M used thread colors in descending order of the use frequencies, it is possible that the CPU 11 selects a plurality of colors that appear to the human eye to be similar. In that case, the overall number of colors that can be expressed by the M used thread colors is made smaller. Therefore, this selection may not be the optimum selection of the used thread colors. This sort of situation may occur even if the CPU 11 performs processing that does not select colors whose distance from one another in the RGB space is less than a specified threshold value, because the calculated similarity of the colors does not necessarily match the similarity as seen by the human eye. For example, a dark gray color and a dark brown color that appear quite similar to the human eye are separated by a considerable distance in the RGB space. For that reason, the dark gray color and the dark brown color can both be selected as used thread colors.

In contrast to this, in the present embodiment, the groups are classified in advance according to the similarity of the colors as seen by the human eye, as explained above. Therefore, the result is that colors that do not appear to be particularly similar are sequentially selected one at a time from each group, creating a good balance. Accordingly, classifying a dark gray color and a dark brown color that appear similar to the human eye into the same group in advance, for example, reduces the possibility that both colors will be selected as two of the limited number of the used thread colors. Thus, according to the embroidery data generation device 1 of the present embodiment, the embroidery data can be generated by selecting, from among the plurality of usable thread colors, thread colors that are suitable for expressing the original image.

Furthermore, in a case where the number of selections does not reach the number of used thread colors M in the first round of the processing for all of the groups, the CPU 11 re-calculates the total values of the use frequencies for the individual groups, with the use frequencies of the used thread colors that have already been selected being excluded. The CPU 11 then re-sets the priority orders based on the newly calculated total values. The CPU 11 selects the color with the highest use frequency among the unselected usable thread colors in each group, processing the groups in descending order of the newly calculated priority orders.

For example, in a case where usable thread colors Y and Z are contained in a group X that contains only those two usable thread colors, and the use frequency for the usable thread color Y is significantly higher than that for the usable thread color Z, it may happen that the total value of the use frequencies for the group X is the highest of all the groups, even if the use frequency of the usable thread color Z is lower than the use frequencies of the usable thread colors in the other groups. However, after the usable thread color Y is selected in the first round of the processing, the use frequency of the usable thread color Y is excluded when the total value of the use frequencies for the group X is calculated again, so the priority order for the group X drops. Therefore, a usable thread color with the highest use frequency in a different group with a higher priority order is selected as a used thread color before the usable thread color Z in the group X. Thus, according to the embroidery data generation device 1 of the present embodiment, the used thread colors can be selected in the second and subsequent rounds of the processing by appropriately taking into account the total use frequencies for the groups and the use frequencies of the individual usable thread colors.

Furthermore, in the present embodiment, the CPU 11 performs the selecting of the used thread colors by first excluding any group for which the total value of the use frequencies is not greater than the first threshold value T1 and any usable thread color for which the use frequency is not greater than the second threshold value T2. In a case where the number of the selected used thread colors has not reached the number of used thread colors M as a result, the CPU 11 stops the use of the first threshold value T1 and the second threshold value T2 in that order.

A low total value of the use frequencies for a group means that all of the usable thread colors that belong to the group are colors that are not to be used very much for expressing the colors of the original image. Therefore, using the first threshold value T1 to select a used thread color from a group for which the total value of the use frequencies is fairly high before selecting a used thread color from the group with the low total value makes it possible to select used thread colors that are more suitable for expressing the original image. A low use frequency for a usable thread color means that the color is not to be used very much for expressing the colors of the original image, even if that usable thread color has a relatively high use frequency within the group. Therefore, using the second threshold value T2 to give priority to selecting, as a used thread color, the usable thread color for which the use frequency is fairly high makes it possible to select used thread colors that are more suitable for expressing the original image.

In the present embodiment, an example is explained in which both the first threshold value T1 and the second threshold value T2 are used. However, the CPU 11 may also use only one of the first threshold value T1 and the second threshold value T2 in the selection processing in FIG. 6. Furthermore, in a case where the number of the selected used thread colors has not reached the number of used thread colors M, the order in which the CPU 11 stops the use of the first threshold value T1 and the second threshold value T2 is not limited to the first threshold value T1 first and then the second threshold value T2, as in the example in the present embodiment. The order may also be the second threshold value T2 first and then the first threshold value T1. The CPU 11 may also stop the use of both threshold values at the same time. It is also acceptable for the first threshold value T1 and the second threshold value T2 not to be used at all.

Second Embodiment

Hereinafter, a second embodiment will be explained with reference to FIGS. 8 and 9. The configurations of the embroidery data generation device 1 and the sewing machine 3 according to the second embodiment and a third embodiment, which will be described later, are the same as in the first embodiment. Therefore, explanations of the configurations will be omitted. Furthermore, in the embroidery data generation processing in the second embodiment and the third embodiment that will be described later, only a portion of the thread color setting processing (FIG. 4, Step S4; FIG. 5) differs from the processing in the first embodiment. Therefore, hereinafter, for the portions of the processing that are the same as in the first embodiment, the same step numbers will be assigned, and the explanations will be omitted or simplified. The processing that is different from the first embodiment will be explained in detail. In the explanation that follows, the number of the usable thread colors is N, and the number of the groups of thread colors is G, in the same manner as in the first embodiment.

Figure 8:
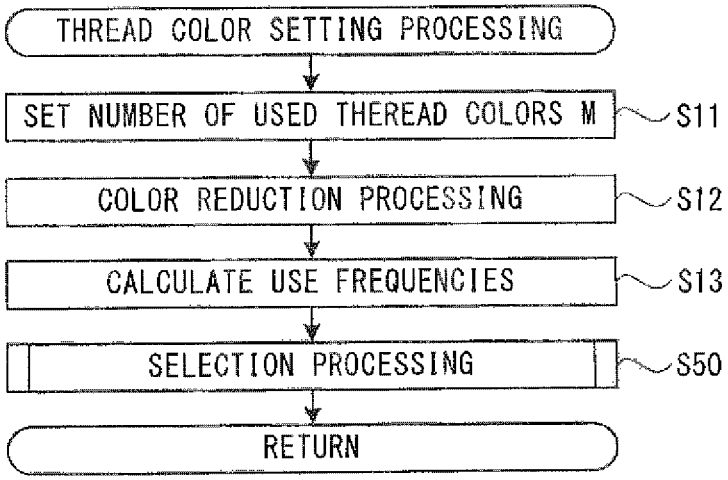
FIG. 8 is a flowchart of thread color setting processing according to a second embodiment.
Figure 9:
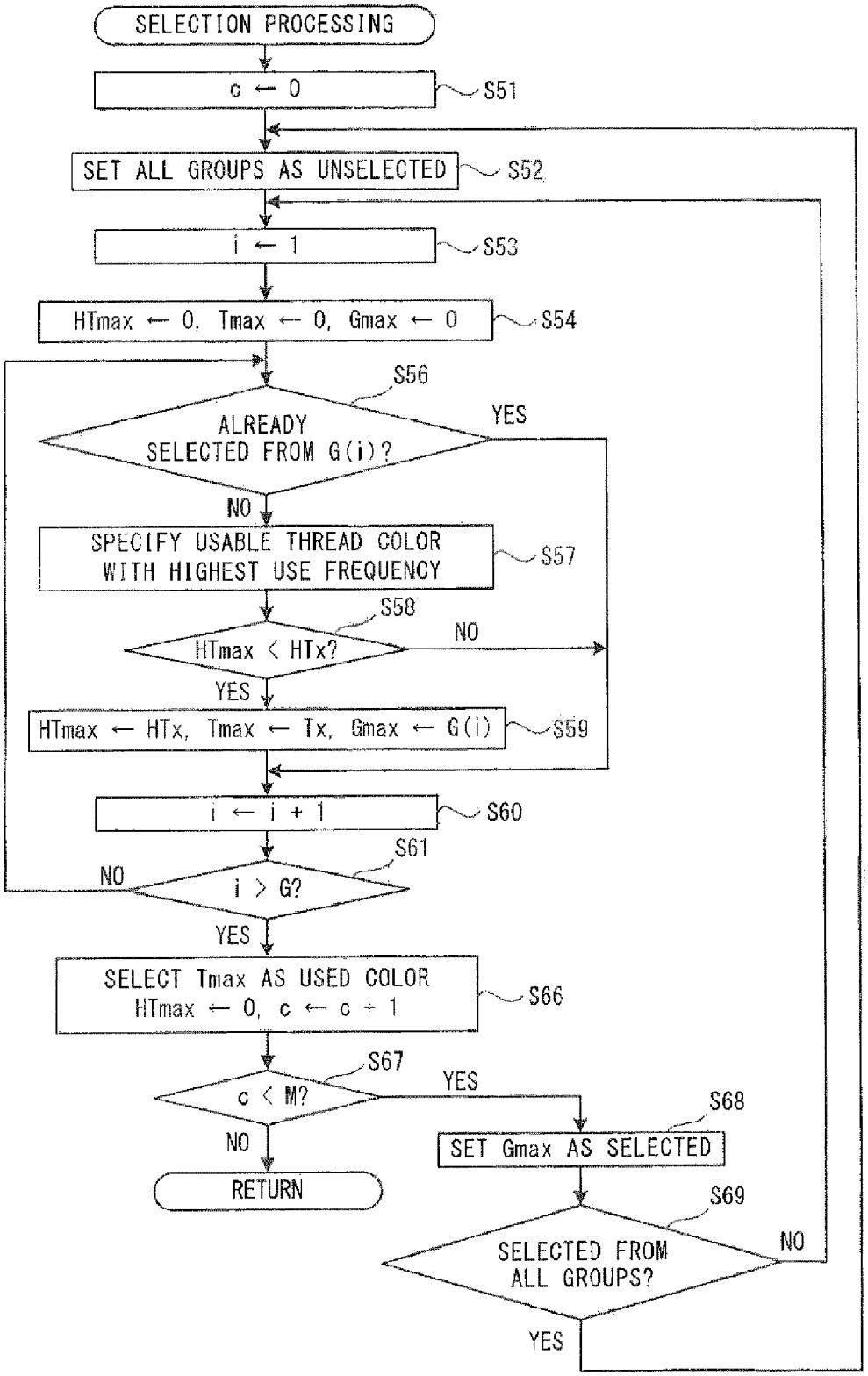
FIG. 9 is a flowchart of selection processing according to the second embodiment.

As shown in FIG. 8, in the thread color setting processing in the second embodiment, the processing (Steps S11 to S13) in which the CPU 11 sets the number of used thread colors M, performs the color reduction processing based on the image data for the original image, and then calculates the use frequency for each of the usable thread colors is the same as in the first embodiment (refer to FIG. 5). Then, unlike in the first embodiment, the CPU 11 proceeds to the selection processing (Step S50) without setting the first threshold value T1 and the second threshold value T2.

The selection processing in the second embodiment will be explained in detail with reference to FIG. 9. First, the CPU 11 sets to zero the variable c for counting the number of selections, and stores the variable c in the RAM 12 (Step S51). The CPU 11 sets all of the G groups as groups from which a used thread color has not been selected (Step S52). For example, by storing selection flags in the RAM 12 in association with the identification data for each of the G groups, the CPU 11 can specify whether or not a used thread color has been selected from any particular group. At Step S52, the CPU 11 sets the selection flags for all of the groups to zero, which is a value that indicates that no selection has been made.

The CPU 11 sets the variable i to 1 and stores the variable i in the RAM 12 (Step S53). In the present embodiment, the variable i is a variable that specifies the object group in accordance with the order in which the groups are registered in the thread color table. In other words, at Step S53, the first group that is registered in the thread color table (group 1 in the example in FIG. 3) is specified as the object of the processing. Hereinafter, the i-th group in the register order, which is the object group, will also be referred to as the group G(i).

The CPU 11 sets to zero and stores in the RAM 12 variables HTmax, Tmax, and Gmax, which are to be used in the process of selecting one used thread color from each of the G groups (Step S54). The variable HTmax is a variable for specifying the highest use frequency among the use frequencies for all of the usable thread colors. The variable Tmax is a variable for specifying the usable thread color with the highest use frequency among all of the usable thread colors. The variable Gmax is a variable for specifying the group to which the usable thread color with the highest use frequency among all of the usable thread colors belongs.

By referring to the selection flag that is stored in the RAM 12, the CPU 11 determines whether or not a used thread color has been selected from the group G(i) (Step S56). In a case where the selection flag is still zero, as it was set at Step S52, a used thread color has not yet been selected from the group G(i) (NO at Step S56). In that case, the CPU 11 specifies the usable thread color Tx that has the highest use frequency among the usable thread colors that belong to the group G(i) (Step S57).

The CPU 11 determines whether or not the use frequency HTx for the usable thread color Tx that was specified at Step S57 is greater than the variable HTmax (Step S58). In the processing of the first group G(1), HTmax is zero, as it was set at Step S54. Therefore, if the use frequency HTx is not zero, HTx will be greater than the variable HTmax (YES at Step S58). In that case, the CPU 11 sets the variables HTmax, Tmax, and Gmax to the values of HTx, Tx, and G(i), respectively (Step S59). In other words, information that indicates the highest use frequency that has been found up to this point, the corresponding usable thread color, and the group to which the usable thread color belongs is stored in the RAM 12.

The CPU 11 adds 1 to the variable i, thereby setting the next group that is registered in the thread color table as the object of the processing (Step S60). Next, the CPU 11 determines whether or not the variable i has exceeded the number of groups G, that is, whether or not all of the groups have been the object of a full round of the processing (Step S61). If the variable i has not exceeded the number of groups G (NO at Step S61), there are still one or more groups that have not been made the object of the processing, so the CPU 11 returns to the processing at Step S56. The CPU 11 performs the processing for the next object group as described above.

In a case where a used thread color has not yet been selected from the next group G(i) (NO at Step S56), the CPU 11 specifies the usable thread color Tx that has the highest use frequency in the group G(i) (Step S57). In a case where, in a previous round of the processing at Step S59, the use frequency of the usable thread color with the highest use frequency in the group that is registered before the group G(i) was stored as the variable HTmax, then if the use frequency HTx for the usable thread color Tx in the group G(i) is greater than the variable HTmax (YES at Step S58), the CPU 11 sets the variables HTmax, Tmax, and Gmax to the values of HTx, Tx, and G(i), respectively, that were set at Step S57. In other words, if the CPU 11 finds a usable thread color that has a higher use frequency than the use frequency for the previously processed group or groups, the CPU 11 updates the variables HTmax, Tmax, and Gmax.

On the other hand, if a usable thread color that has a higher use frequency than the use frequency for the previously processed group or groups is not found, the use frequency HTx is not greater than the variable HTmax (NO at Step S58). The CPU 11 then advances to the processing at Step S60 and sets the next group as the object of the processing.

Thus, when the CPU 11 has completed a full round of the processing at Steps S56 to S60 for all of the G groups, the variable i is greater than the number of groups G (YES at Step S61). The CPU 11 selects, as a used thread color, the usable thread color that is specified by the variable Tmax that is stored in the RAM 12 (Step 66). The CPU 11 also sets to zero the use frequency for the usable thread color that was selected as the used thread color, which is the use frequency that is specified by the variable HTmax, and adds 1 to the value of the variable c (Step S66). The CPU 11 determines whether or not the variable c is less than the number of used thread colors M (Step S67). In a case where the variable c is less than the number of used thread colors M (YES at Step S67), the CPU 11 sets to 1 the selection flag for the group that is indicated by the variable Gmax, thereby indicating that a used thread color has been selected from the group that is indicated by the variable Gmax (Step S68).

Based on whether or not all of the selection flags in the RAM 12 indicate 1, the CPU 11 determines whether or not one used thread color has been selected from every one of the G groups (Step S69). In a case where one or more groups remain for which a used thread color has not been selected (NO at Step S69), the CPU 11 once again sets the variable i to 1 (Step S53). The CPU 11 then resets each of the variables HTmax, Tmax, and Gmax to zero (Step S54), and repeats the previously described processing at Steps S56 to S61 for each of the G groups. In a case where the CPU 11 returns the processing to Step S53, the groups from which used thread colors have already been selected are excluded from the selecting of the used thread colors (YES at Step S56). In other words, the CPU 11 performs the selecting of the used thread colors by giving priority to groups from which the number of used thread colors that have already been selected is lower.

In a case where the number of groups G is not less than the number of used thread colors M, the variable c, that is, the number of selections, reaches the number of used thread colors M when the CPU 11 has selected the used thread colors one at a time from M groups among the G groups (NO at Step S67). In that case, the CPU 11 terminates the selection processing in FIG. 9, then returns to the thread color setting processing in FIG. 8 and terminates the thread color setting processing.

On the other hand, in a case where the number of groups G is less than the number of used thread colors M, the variable c, that is, the number of selections, remains to be less than the number of used thread colors M (YES at Step S67), when the CPU 11 completes the selecting of the used thread colors one at a time from all of the G groups (YES at Step S69). In this case, the CPU 11, in order to select another used thread color, returns the processing to Step S52 and sets all of the G groups as groups from which a used thread color has not been selected. The CPU 11 repeats the same processing for as long as the variable c is less than the number of used thread colors M. In this case, the use frequencies for the usable thread colors that have already been selected as the used thread colors were set to zero in previous rounds of the processing at Step S66, so the color with the highest use frequency among the unselected usable thread colors is selected from each of the groups in order. When the variable c, that is, the number of selections, reaches the number of used thread colors M (NO at Step S67), the CPU 11 terminates the selection processing in FIG. 9, then returns to the thread color setting processing in FIG. 8 and terminates the thread color setting processing.

As explained above, in the present embodiment, the plurality of usable thread colors are divided into one or more groups in advance according to the similarity as seen by the human eye, in the same manner as in the first embodiment. From each of the G groups, the CPU 11 selects a color with the highest use frequency among the N usable thread colors, giving priority to a group from which the fewest number of usable thread colors have already been selected as the used thread colors, until the number of selections reaches the number of used thread colors M. Accordingly, in the same manner as in the first embodiment, colors that do not appear to be particularly similar are sequentially selected one at a time from each group, creating a good balance. Therefore, according to the embroidery data generation device 1 of the present embodiment, the embroidery data can be generated by selecting, from among the plurality of usable thread colors, thread colors that are suitable for expressing the original image.

Furthermore, in the present embodiment, unlike in the first embodiment, the priority orders for the groups are not set according to the total values of the use frequencies. It is therefore possible to select used thread colors that better reflect the use frequencies for the individual usable thread colors.

Third Embodiment

Hereinafter, the third embodiment will be explained with reference to FIGS. 10 to 12. In the embroidery data generation device 1 in the third embodiment, the thread color table that is stored in the setting values storage area 154 of the HDD 15 (refer to FIG. 1) is different from the thread color table in the first embodiment that is shown in FIG. 3. Furthermore, the content of the embroidery data generation processing that is shown in FIG. 4 differs from the first embodiment only in the thread color setting processing. Note that the thread color setting processing in the third embodiment differs from the thread color setting processing in the second embodiment that is shown in FIG. 8 only in the content of the selection processing (Step S50). Accordingly, hereinafter, only the thread color table that is used in the present embodiment and the content of the selection processing will be explained.

The thread color table that is used in the present embodiment will be explained with reference to FIG. 10. As shown in FIG. 10, the thread color table in the present embodiment is a table in which identification data for the groups (indicated by numbers in FIG. 10), identification data for sub-groups within a group (indicated by numbers in FIG. 10), identification data for the usable thread colors within a sub-group (indicated by English letters in FIG. 10), and data that indicate the RGB values for the usable thread colors are associated with one another. The thread color table in FIG. 10 is an example in which the usable thread colors have been divided in advance into four groups, with each one of groups 1 to 3 being divided into two sub-groups and group 4 having one sub-group.

The thread color table in the present embodiment is created by a person by dividing the plurality of usable thread colors into groups of colors that appear to be similar, and then dividing the usable thread colors that belong to each of the groups into sub-groups of colors that appear to be even more similar. Note that in a case where only one color belongs to a group, the number of sub-groups is one. The number of sub-groups is also one in a case where the person who classifies the usable thread colors has determined that all of the plurality of usable thread colors that belong to the particular group appear to be very similar to one another, as in group 4 in FIG. 10. Note that the thread color table in FIG. 10 is merely an example, and the number of groups and the number of sub-groups are not limited to the numbers in this example. A sub-group may also be divided into lower-level sub-groups of colors that appear to be even more similar to one another.

The selection processing in the present embodiment will be explained with reference to FIGS. 11 and 12. In the explanation that follows, the number of usable thread colors is N, the number of groups is G, and the number of sub-groups is SG. As shown in FIG. 11, first, based on the use frequency for each of the plurality of usable thread colors, which was calculated at Step S13 in the thread color setting processing (refer to FIG. 8), the CPU 11 calculates the total value of the use frequencies for each sub-group (Step S71), and also calculates the total value of the use frequencies for each group (Step S72). Hereinafter, the total value of the use frequencies for a group and the total value of the use frequencies for a sub-group will be called a first total value and a second total value, respectively. The CPU 11 sets the priority orders for the groups in descending order of the first total values (Step S73) and sets the priority orders for the sub-groups in descending order of the second total values (Step S74). Hereinafter, the priority order for a group and the priority order for a sub-group within a group will be called a first priority order and a second priority order, respectively.

In the present embodiment, in the processing at Steps 13 and S71 to S74 described above, the CPU 11 generates and stores in the RAM 12 a use frequency table like the example that is shown in FIG. 12, based on the thread color table and on the use frequencies, the first total values, the second total values, the first priority orders, and the second priority orders that were calculated by the processing at the respective steps.

The use frequency table that is shown in FIG. 12 is an example that is generated for an original image of 640 pixels by referring to the thread color table (refer to FIG. 10) in which nineteen usable thread colors were divided into four groups in advance, groups 1 to 3 were each divided into two sub-groups, and one sub-group was established in group 4. In the use frequency table in FIG. 12, the identification data (the numbers) for the groups, the identification data (the numbers) for the sub-groups within the groups, the numbers of the usable thread colors within the sub-groups, the use frequencies of the individual usable thread colors within the sub-groups, the second total values, the second priority orders, the first total values, and the first priority orders are associated with one another. However, as was explained in the first embodiment, this sort of use frequency table does not necessarily have to be generated.

The CPU 11 sets a variable SSi(i) (where i is an integer from 1 to G) to 1 (Step S75). The variable SSi(i) is a variable for specifying the second priority order of the sub-group at which a search will be started within each group. The CPU 11 sets to zero the variable c for counting the number of selections (Step S76). The CPU 11 sets to 1 the variable i for specifying the object group according to the first priority order (Step S81). In other words, the group for which 1 has been set as the first priority order (group 3 in the example in FIG. 12) is specified as the object of the processing.

The CPU 11 determines whether or not a selectable usable thread color is remaining within the object group S(i) (Step S82). In a case where the processing has been repeated several times and all of the usable thread colors in the object group have been selected as used thread colors (NO at Step S82), the CPU 11 advances the processing to Step S111.

The CPU 11 sets a variable j to the value of the variable SSi(i) and sets a variable k to the value of the variable j (Step S83). The variable j is a variable for specifying the sub-group that is the object of the processing in accordance with the second priority orders within the object group S(i). The variable k is a variable that indicates whether or not the sub-group that is the object of the processing (hereinafter called the object sub-group) has already been processed. Hereinafter, within the group S(i) with the i-th first priority order, the sub-group with the j-th second priority order will also be referred to as the sub-group SS(i, j). In the first round of the processing, the variable SSi(i) has been set to 1 at Step S75, as described previously, so the CPU 11 sets the variable j to 1 at Step S83. Thus, within the group with the first priority order of 1, the sub-group with the second priority order of 1 (the sub-group 1 within the group 3 in FIG. 12) is specified as the object sub-group.

The CPU 11 determines whether or not there is a selectable usable thread color remaining in the object sub-group SS(i, j) (Step S84). In a case where there is a selectable usable thread color (YES at Step S84), the CPU 11, by referring to the use frequency table in the RAM 12, specifies the usable thread color with the highest use frequency among the unselected usable thread colors (Step S86). For example, in a case where the use frequency table in FIG. 12 is referenced, a usable thread color B that has the highest use frequency of 100 is specified, among the unselected usable thread colors that belong to the object sub-group SS(1, 1), that is, sub-group 1 within group 3.

Note that because every one of the sub-groups contains one or more usable thread colors, in the first round of processing, if the number of groups G is not less than the number of used thread colors M, the CPU 11 determines, for every one of the sub-groups, that there is a selectable usable thread color (YES at Step S84).

The CPU 11 selects, as a used thread color, the usable thread color Tx that was specified at Step S86, stores information that identifies the usable thread color Tx in the RAM 12, sets the value of the use frequency HTx to zero in the use frequency table, and adds 1 to the value of the variable c (Step S87). The CPU 11 adds 1 to the variable j and sets the variable SSi(i) to the resulting value (Step S88). Thus the sub-group at which the next search will start is changed to the sub-group with the next second priority order within the same group.

The CPU 11 determines whether or not the variable SSi(i) has exceeded the number of sub-groups SG (Step S89). For example, there is only one sub-group in group 4 in FIG. 12. For that reason, after a thread color A has been selected from the sub-group SS(4, 1) in the first round of the processing, when the variable SSi(i) is set to 2, the variable SSi(i) exceeds the number of sub-groups 1 (YES at Step S89). This means that the processing has been completed for all of the sub-groups within the object group S(i). Therefore, the CPU 11 resets the variable SSi(i) to 1 (Step S90) and advances the processing to Step S91. In a case where the variable SSi(i) has not exceeded the number of sub-groups SG (NO at Step S89), there is still a sub-group within the group that has not been made the object of the processing. Therefore, the CPU 11 advances the processing to Step S91 without resetting the variable SSi(i).

At Step S91, the CPU 11 determines whether or not the variable c, that is the number of selections, is less than the number of used thread colors M. In a case where the variable c is less than the number of used thread colors M (YES at Step S91), the CPU 11 adds 1 to the value of the variable i to set the next group in the first priority order as the object of the processing (Step S111). Next, the CPU 11 determines whether or not the variable i has exceeded the number of groups G, that is, whether or not all of the groups have been the object of a full round of the processing (Step S112). If the variable i has not exceeded the number of groups G (NO at Step S112), there are still one or more groups that have not been made the object of the processing, so the CPU 11 returns to the processing at Step S82. The CPU 11 performs the processing described above for the next group.

In this way, the CPU 11 completes the full round of the processing at Steps S82 to S91 and S111 to S112 for all of the G groups, and when a used thread color has been selected from one of the sub-groups in every one of the groups, the variable i exceeds the number of groups G (YES at Step S112). The CPU 11 returns the processing to Step S81 in order to select another used thread color and once again sets, as the object of the processing, the group for which the first priority order is 1.

In the second and subsequent rounds of processing, for any group in which one or more sub-groups remain that have not been made the object of the processing, the next sub-group at which the search will start is set based on the variable SSi(i) that was changed in the preceding round of the processing at Step S88, as described previously. Accordingly, in the second round of the processing for the object group S(1), for example, the CPU 11 selects the usable thread color with the highest use frequency from the object sub-group SS(1, 2). For example, in a case where the use frequency table in FIG. 12 is referenced, the CPU 11 selects a usable thread color D that has the highest use frequency of 10 in sub-group 2 within group 3. On the other hand, in the second round of the processing for the object group S(4), for example, the variable SSi(i) was set to 1 in the preceding round of the processing at Step S90. Therefore, the CPU 11 selects the usable thread color B that has the highest use frequency of 80, among the unselected usable thread colors that belong to the object sub-group SS(4, 1).

In a case where the number of groups G is less than the number of used thread colors M and the result of the performing of the second and subsequent rounds of processing is that there is no unselected usable thread color remaining in the object sub-group SS(i, j) (NO at Step S84), the CPU 11 adds 1 to the variable j, thereby changing the object sub-group to the next sub-group in the second priority order within the same object group S(i) (Step S101).

The CPU 11 determines whether or not the variable j has exceeded the number of sub-groups SG (Step S102). In a case where the variable j has exceeded the number of sub-groups SG (YES at Step S102), there is no sub-group remaining in the object group S(i) that can be made the object of the processing. Accordingly, the CPU 11 resets the variable j to 1 (Step S103) and advances the processing to Step S104. In a case where the variable j has not exceeded the number of sub-groups SG (NO at Step S102), there are one or more sub-groups that can be made the object of the processing. Accordingly, the CPU 11 advances the processing to Step S104 without resetting the variable j.

The CPU 11 determines whether or not the variable j is equal to the variable k (Step S104). In a case where the processing has been completed for the object sub-group SS(i, j), the variable k was set to the variable j in the preceding round of the processing at Step S83. Accordingly, in a case where the variable j is equal to the variable k (YES at Step S104), the CPU 11 advances the processing to Step S111 and sets the next group in the first priority order as the object of the processing. In a case where the variable j is not equal to the variable k (NO at Step S104), the CPU 11 returns the processing to Step S84 and performs the processing for the next sub-group.

For as long as the variable c is less than the number of used thread colors M, the CPU 11 repeats the processing in the same manner. When the variable c, that is, the number of selections, reaches the number of used thread colors M (NO at Step S91), the CPU 11 terminates the selection processing in FIG. 11.

As explained above, in the present embodiment, the thread color table is generated by dividing the plurality of usable thread colors into one or more groups in advance according to the similarity as seen by the human eye, and then further dividing each of the groups into one or more sub-groups. The CPU 11 calculates the total value of the use frequencies for the usable thread colors in each group (the first total value) and the total value of the use frequencies in each sub-group (the second total value). The CPU 11 sets the priority orders for the groups (the first priority orders) in descending order of the first total values and sets the priority orders for the sub-groups within each group (the second priority orders) in descending order of the second total values.

Processing the groups in order according to the first priority orders, the CPU 11 selects, as a used thread color, an unselected usable thread color with the highest use frequency in the sub-group with the highest second priority order within each group. In a case where the number of selections does not reach the number of used thread colors M, even if one used thread color is selected from each group, the CPU 11 selects a color with the highest use frequency in the sub-group within each group, processing the groups and sub-groups in descending order of the first priority orders and the second priority orders, until the number of selections reaches the number of used thread colors M. In other words, from the sub-group with the highest second total value among the sub-groups from which the fewest number of used thread colors have already been selected, the unselected usable thread color with the highest use frequency is selected.

Accordingly, in the same manner as in the first embodiment, colors that do not appear to be particularly similar are sequentially selected one at a time from each group, creating a good balance. Furthermore, by dividing the groups into sub-groups, the colors that are selected can be evenly distributed, even within each group. For that reason, a richer array of colors can be expressed as a whole. Therefore, according to the embroidery data generation device 1 of the present embodiment, the embroidery data can be generated by selecting, from among the plurality of usable thread colors, thread colors that are suitable for expressing the original image.

In the present embodiment, once the first priority orders and the second priority orders are set based on the first total values and the second total values that are initially calculated, they are not changed thereafter. However, as in the first embodiment, the CPU 11 may also reset the first priority orders and the second priority orders by re-calculating the first total values and the second total values in the second and subsequent rounds of processing, excluding the use frequencies for the usable thread colors that have already been selected as used thread colors. The second threshold value T2 may also be used in the same manner as in the first embodiment.

In the present embodiment, an example has been explained in which the groups are divided into sub-groups of colors that appear to be more similar, but the criteria for dividing the groups into sub-groups does not necessarily have to be the similarity of the colors as seen by the human eye. For example, the sub-groups may be generated based on the saturation of each of the individual usable thread colors. In that case, a person may first divide the plurality of usable thread colors into groups based on the criteria of whether or not the colors appear to be similar. Then the CPU 11 calculates the saturation of each usable thread color based on data that indicate the RGB values for the color. The CPU 11 may divide the usable thread colors in the group into a sub-group 1 including one or more usable thread colors whose calculated saturation are greater than a specified threshold value TS and a sub-group 2 including one or more usable thread colors whose saturation are not greater than the specified threshold value TS. The threshold value TS may be a value that is set in advance, and may also be a value that is designated by the user. Note that a saturation S for a color whose RGB values are (r, g, b) can be calculated based on the equations below.

$$MAX=\max(r,g,b)$$

$$MIN=\min(r,g,b)$$

$$S=(MAX-MIN)/MAX$$

In a case where mixed color expression is performed by combining a plurality of colors, a color with high saturation (a vivid color) cannot be expressed by including in the combination a color with low saturation (a color that is not vivid). For example, even though a red with low saturation can be expressed by combining a vivid red and a gray with low saturation, a vivid red cannot be expressed by combining a red with low saturation and another color with high saturation. Accordingly, in a case where the sub-groups are defined according to the saturation of the usable thread colors as described above, at Step S74 in FIG. 11, the CPU 11 may define the second priority orders starting with the sub-group whose colors have the higher saturations, such that sub-group 1 has a higher second priority order than does sub-group 2. In that case, a more vivid color can reliably be selected first as a used thread color.

In addition to the saturation, the distance from the median values in the RGB space, that is, the distance from gray, may also be used as the criteria for defining the sub-groups. For example, even though gray can be expressed by combining white and black, neither white nor black can be expressed by using gray. Accordingly, the CPU 11 may define sub-group 1 as one or more usable thread colors whose distance from the median values (128, 128, 128) in the RGB space are greater than a specified threshold value D and define sub-group 2 as one or more usable thread colors whose distance from the median values are not greater than the specified threshold value D, so that a larger number of colors can be expressed by combinations, in the same manner as in the case where the sub-groups are defined based on the saturations of the usable thread colors.

The present disclosure is not limited to the embodiments that have been described above, and various types of modifications can be made. For example, in the embodiments described above, examples are explained in which, in the selecting of the used thread colors, priority is given to the usable thread color with a higher use frequency within the group. However, the priority orders may also be set by a different method whose objective is to select M used thread colors that are more uniformly distributed in the color space. An example of such a selection method will hereinafter be described.

For example, the CPU 11 calculates the use frequency for each usable thread color in the same manner as in the first embodiment and the second embodiment. Then, in a case where the number of groups G is not less than the number of used thread colors M, that is, in a case where the number of selections will reach the number of used thread colors M if one used thread color is selected from each group, the CPU 11 calculates the median values in the RGB space of the usable thread colors in each group. The CPU 11 gives priority to selecting a usable thread color whose distance from the median values is shortest. The result of this method is that the color that is selected from each group is an average color within the group. Therefore, so M used thread colors can be selected that are more uniformly distributed in the color space.

When the number of the usable thread colors within a group is n, the usable thread colors are respectively thread color 1, the thread color 2, . . . thread color n, the RGB values for the usable thread colors are respectively (r1, g1, b1), (r2, g2, b2), (rn, gn, bn), and the use frequencies for the usable thread colors are respectively h1, hs, . . . hn, the median values (Cr, Cg, Cb) in the RGB space of the usable thread colors that belong to the group can be calculated by the equations below.

$$Cr=(r1\times h1+r2\times h2+\ldots m\times hn)/(h1+h2+\ldots hn)$$

$$Cg=(g1\times h1+g2\times h2+\ldots gn\times hn)/(h1+h2+\ldots hn)$$

$$Cb=(b1\times h1+b2\times h2+\ldots bn\times hn)/(h1+h2+\ldots hn)$$

In a case where the number of groups G is less than the number of used thread colors M, that is, in a case where the number of selections will not reach the number of used thread colors M even if one used thread color is selected from each group, then for every group from which not less than two used thread colors are selected, the CPU 11 calculates the distance in the RGB space between the two colors in every possible combination of two usable thread colors in the group. The CPU 11 selects as the used thread colors the two colors for which the calculated distance for the combination is the greatest. This makes it possible to select used thread colors that are distributed within a broader range in the RGB space. The first color that the CPU 11 selects from each group may also be the usable thread color with the highest use frequency in the group, and the second color that the CPU 11 selects may be the usable thread color that is separated from the first color by the greatest distance.

The method hereinafter described may also be used. In the first round of the processing the CPU 11 selects a usable thread color C1, which has the highest use frequency within the group that has the highest total value of the use frequencies. Then, from the group that has the next-highest total value of the use frequencies, the CPU 11 selects a usable thread color C2, whose distance from the usable thread color C1 in the RGB space is the greatest in that group. Next, from the group that has the next-highest total value of the use frequencies, the CPU 11 selects a usable thread color C3, whose distances from the usable thread color C1 and the usable thread color C2 in the RGB space are the greatest in that group. The CPU 11 repeats this processing until the number of selections reaches the number of used thread colors M. In this case as well, used thread colors can be selected that are distributed within a broader range in the RGB space.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A device, comprising:

a processor; and a memory configured to store:

a plurality of group information pieces respectively identifying a plurality of groups, each group information piece being associated with one or more thread colors among a plurality of thread colors, the plurality of thread colors being used in embroidery sewing, and computer-readable instructions that, when executed, cause the processor to perform processes comprising:

acquiring image data including a plurality of pixels, the image data representing an image, replacing, based on the image data, a color of each one of the plurality of pixels with a thread color from the plurality of thread colors, calculating a frequency of applying each of the plurality of thread colors based on the colors of the plurality of pixels after the replacing of the colors, selecting one thread color from each of the plurality of group information pieces sequentially based on the plurality of group information pieces stored in the memory and on the calculated frequency of using each of the plurality of thread colors until the number of thread colors selected from the plurality of thread colors is equal to the number of thread colors to be used stored in the memory, the selecting of the one thread color from each of the plurality of group information pieces include:

calculating, based on the calculated frequency of using each of the plurality of thread colors, a total value with respect to each of the plurality of group information pieces, the total value being a sum of the calculated frequency corresponding to each of the one or more thread colors associated with the group information piece, setting priority orders for the plurality of groups, in descending order of the calculated total values, and selecting, until the number of thread colors selected from the plurality of thread colors is equal to the number of thread colors to be used stored in the memory, one thread color with the highest frequency from each of the plurality of group information pieces sequentially, according to the priority orders, and generating embroidery data for forming stitches in the selected thread colors by a sewing machine, based on the image data and the selected thread colors.

2. The device according to claim 1, wherein the selecting of the one thread color from each of the plurality of group information pieces further includes:

determining whether or not the number of thread colors selected from the plurality of thread colors is equal to the number of thread colors to be used stored in the memory, when the selecting of the one thread color with the highest frequency from each of the plurality of group information pieces has completed, re-calculating, in response to determining that the number of thread colors selected from the plurality of thread colors is not equal to the number of thread colors to be used stored in the memory, the total value with respect to each of the plurality of group information pieces, based on the frequency of each of the one or more of the plurality of thread colors other than the selected thread color among the plurality of thread colors, re-setting the priority orders for the plurality of groups, in descending order of the re-calculated total values, and selecting one thread color with the highest frequency other than the selected thread color from each of the plurality of group information pieces sequentially, according to the re-set priority orders, until the number of thread colors selected from the plurality of thread colors is equal to the number of thread colors to be used stored in the memory.

3. The device according to claim 1, wherein the selecting of the one thread color with the highest frequency from each of the plurality of group information pieces includes:

selecting, until the number of thread colors selected from the plurality of thread colors is equal to the number of thread colors to be used stored in the memory, one thread color with the highest frequency from each of one or more first specified groups sequentially, according to the priority orders, each of the one or more first specified groups being a group among the plurality of groups and being a group for which the total value is greater than a first threshold, determining whether or not the number of thread colors selected from the plurality of thread colors is equal to the number of thread colors to be used stored in the memory, when the selecting of the one thread color with the highest frequency from each of the one or more first specified groups has completed, and selecting, in response to determining that the number of thread colors selected from the plurality of thread colors is not equal to the number of thread colors to be used stored in the memory, one thread color with the highest frequency other than the selected thread colors from each of the plurality of group information pieces sequentially, according to the priority orders, until the number of thread colors selected from the plurality of thread colors is equal to the number of thread colors to be used stored in the memory.

4. The device according to claim 1, wherein the selecting of the one thread color with the highest frequency from each of the plurality of group information pieces includes:

selecting, until the number of thread colors selected from the plurality of thread colors is equal to the number of thread colors to be used stored in the memory, one thread color with the highest frequency among one or more of thread colors with the frequency that is greater than a second threshold, from each of the plurality of group information pieces sequentially, according to the priority orders, determining whether or not the number of thread colors selected from the plurality of thread colors is equal to the number of thread colors to be used stored in the memory, when the selecting of the one thread color with the highest frequency among one or more of thread colors with the frequency that is greater than the second threshold from each of the plurality of group information pieces has completed, and selecting, in response to determining that the number of thread colors selected from the plurality of colors is not equal to the number of thread colors to be used stored in the memory, one thread color with the highest frequency other than the selected thread colors from each of the plurality of group information pieces sequentially, according to the priority orders, until the number of thread colors selected from the plurality of thread colors is equal to the number of thread colors to be used stored in the memory.

5. The device according to claim 1, wherein the selecting of the one thread color from each of the plurality of group information pieces further includes:

selecting one thread color with the highest frequency among the plurality of thread colors, and selecting one thread color other than the selected thread color with the highest frequency from the one or more thread colors belonging to one or more second specified groups sequentially, until the number of thread colors selected from the plurality of thread colors is equal to the number of thread colors to be used stored in the memory, the one or more second specified groups being one or more groups including a fewest number of selected thread colors.

6. The device according to claim 1, wherein each of the plurality of group information pieces includes one or more sub-group information pieces, each of the one or more sub-group information pieces being associated with one or more thread colors among the plurality of thread colors, and the selecting of the one thread color from each of the plurality of group information pieces further includes:

calculating, based on the calculated frequency of using each of the plurality of thread colors, a first total value with respect to each of the plurality of group information pieces and a second total value with respect to each of the one or more sub-group information pieces, the first total value being a sum of the frequency corresponding to the one or more thread colors associated with the group information piece, and the second total value being a sum of the frequency corresponding to each of the one or more thread colors associated with the sub-group information piece, setting the priority orders for the plurality of groups in descending order of the calculated first total values, and selecting, until the number of thread colors selected from the plurality of thread colors is equal to the number of thread colors to be used stored in the memory, one thread color with the highest frequency in the sub-group with the highest second total value from each of the plurality of groups sequentially, according to the priority orders.

7. The device according to claim 6, wherein the selecting of the one thread color from each of the plurality of group information pieces further includes:

determining whether or not the number of thread colors selected from the plurality of thread colors is equal to the number of thread colors to be used stored in the memory, when the selecting of the one thread color with the highest frequency in the sub-group with the highest second total value from each of the plurality of group information pieces has completed, and selecting, in response to determining that the number of thread colors selected from the plurality of thread colors is not equal to the number of thread colors to be used stored in the memory, one thread color with the highest frequency other than the selected thread color in a specified sub-group from each of the plurality of groups, according to the priority orders, until the number of thread colors selected from the plurality of thread colors is equal to the number of thread colors to be used stored in the memory, the specified sub-group being a sub-group with the highest second total value among the one or more sub-group information pieces including a fewest number of selected thread colors.

8. The device according to claim 6, wherein the one or more sub-group information pieces are classified based on saturation of each of the plurality of thread colors.

9. A non-transitory computer-readable medium storing computer-readable instructions that, when executed by a processor of a device, cause the processor to perform processes comprising:

acquiring image data including a plurality of pixels, the image data representing an image, replacing, based on the image data, a color of each one of the plurality of pixels with a thread color from a plurality of thread colors, calculating a frequency of applying each of the plurality of thread colors based on the colors of the plurality of pixels after the replacing of the colors, selecting one thread color from each of a plurality of group information pieces sequentially based on the plurality of group information pieces and on the calculated frequency of using each of the plurality of thread colors until the number of thread colors selected form the plurality of thread colors is equal to the number of thread colors to be used stored in a memory, the plurality of group information pieces being stored in the memory and respectively identifying a plurality of groups, each information piece being associated with one or more thread colors among the plurality of thread colors, the selecting of the one thread color from each of the plurality of group information pieces includes:

calculating, based on the calculated frequency of using each of the plurality of thread colors, a total value with respect to each of the plurality of group information pieces, the total value being a sum of the calculated frequency corresponding to each of the one or more thread colors associated with the group information piece, setting priority orders for the plurality of groups, in descending order of the calculated total values, and selecting, until the number of thread colors selected from the plurality of thread colors is equal to the number of thread colors to be used stored in the memory, one thread color with the highest frequency from each of the plurality of group information pieces sequentially, according to the priority orders, and generating embroidery data for forming stitches in the selected thread colors by a sewing machine, based on the image data and the selected thread colors.

10. The non-transitory computer-readable medium storing computer-readable instructions according to claim 9, wherein the selecting of the one thread color from each of the plurality of group information pieces further includes:

determining whether or not the number of thread colors selected from the plurality of thread colors is equal to the number of thread colors to be used stored in the memory, when the selecting of the one thread color with the highest frequency from each of the plurality of group information pieces has completed, re-calculating, in response to determining that the number of thread colors selected from the plurality of thread colors is not equal to the number of thread colors to be used stored in the memory, the total value with respect to each of the plurality of group information pieces, based on the frequency of each of the one or more of the plurality of thread colors other than the selected thread color among the plurality of thread colors, re-setting the priority orders for the plurality of groups, in descending order of the re-calculated total values, and selecting one thread color with the highest frequency other than the selected thread color from each of the plurality of group information pieces sequentially, according to the re-set priority orders, until the number of thread colors selected from the plurality of thread colors is equal to the number of thread colors to be used stored in the memory.

11. The non-transitory computer-readable medium storing computer-readable instructions according to claim 9, wherein the selecting of the one thread color with the highest use frequency from each of the plurality of group information pieces includes:

selecting, until the number of thread colors selected from the plurality of thread colors is equal to the number of thread colors to be used stored in the memory, one thread color with the highest frequency from each of one or more first specified groups sequentially, according to the priority orders, each of the one or more first specified groups being a group among the plurality of groups and being a group for which the total value is greater than a first threshold, determining whether or not the number of thread colors selected from the plurality of thread colors is equal to the number of thread colors to be used stored in the memory, when the selecting of the one thread color with the highest frequency from each of the one or more first specified groups has completed, and selecting, in response to determining that the number of thread colors selected from the plurality of thread colors is not equal to the number of thread colors to be used stored in the memory, one thread color with the highest frequency other than the selected thread colors from each of the plurality of group information pieces sequentially, according to the priority orders, until the number of thread colors selected from the plurality of thread colors is equal to the number of thread colors to be used stored in the memory.

12. The non-transitory computer-readable medium storing computer-readable instructions according to claim 9, wherein the selecting of the one thread color with the highest frequency from each of the plurality of group information pieces includes:

selecting, until the number of thread colors selected from the plurality of thread colors is equal to the number of thread colors to be used stored in the memory, one thread color with the highest frequency among one or more thread colors with the frequency that is greater than a second threshold, from each of the plurality of group information pieces sequentially, according to the priority orders, determining whether or not the number of thread colors selected from the plurality of thread colors is equal to the number of thread colors to be used stored in the memory, when the selecting of the one thread color with the highest frequency among one or more thread colors with the frequency that is greater than the second threshold from each of the plurality of group information pieces has completed, and selecting, in response to determining that the number of thread colors selected from the plurality of thread colors is not equal to the number of thread colors to be used stored in the memory, one thread color with the highest frequency other than the selected thread colors from each of the plurality of group information pieces sequentially, according to the priority orders, until the number of thread colors selected from the plurality of thread colors is equal to the number of thread colors to be used stored in the memory.

13. The non-transitory computer-readable medium storing computer-readable instructions according to claim 9, wherein the selecting of the one thread color from each of the plurality of group information pieces includes:

selecting one thread color with the highest frequency among the plurality of thread colors, and selecting one thread color other than the selected thread color with the highest frequency from the one or more thread colors belonging to one or more second specified groups sequentially, until the number of thread colors selected from the plurality of thread colors is equal to the number of thread colors to be used stored in the memory, the one or more second specified groups being one or more groups including a fewest number of selected thread colors.

14. The non-transitory computer-readable medium storing computer-readable instructions according to claim 9, wherein each of the plurality of group information pieces includes one or more sub-group information pieces, each of the one or more sub-group information pieces being associated with one or more thread colors among the plurality of thread colors, and the selecting of the one thread color from each of the plurality of group information pieces includes:

calculating, based on the calculated frequency of using each of the plurality of thread colors, a first total value with respect to each of the plurality of group information pieces and a second total value with respect to each of the one or more sub-group information pieces, the first total value being a sum of the frequency corresponding to the one or more thread colors associated with the group information piece, and the second total value being a sum of the frequency corresponding to each of the one or more thread colors associated with the sub-group information piece, setting the priority orders for the plurality of groups in descending order of the calculated first total values, and selecting, until the number of thread colors selected from the plurality of thread colors is equal to the number of thread colors to be used stored in the memory, one thread color with the highest frequency in the sub-group with the highest second total value in the group from each of the plurality of groups sequentially, according to the priority orders.

15. The non-transitory computer-readable medium storing computer-readable instructions according to claim 14, wherein the selecting of the one thread color from each of the plurality of group information pieces further includes:

determining whether or not the number of thread colors selected from the plurality of thread colors is equal to the number of thread colors to be used stored in the memory, when the selecting of the one thread color with the highest frequency in the sub-group with the highest second total value from each of the plurality of group information pieces has completed, and selecting, in response to determining that the number of thread colors selected from the plurality of thread colors is not equal to the number of thread colors to be used stored in the memory, one thread color with the highest frequency other than the selected thread color in a specified sub-group from each of the plurality of groups, until the number of thread colors selected from the plurality of thread colors is equal to the number of thread colors to be used stored in the memory, the specified sub-group being a sub-group with the highest second total value among the one or more sub-group information pieces including a fewest number of selected thread colors.

16. The non-transitory computer-readable medium storing computer-readable instructions according to claim 14, wherein the one or more sub-group information pieces are classified based on saturation of each of the plurality of usable thread colors.

* * * * *